US008608550B1

(12) United States Patent
Gagner et al.

(10) Patent No.: US 8,608,550 B1
(45) Date of Patent: Dec. 17, 2013

(54) COORDINATING THREE DIMENSIONAL WAGERING GAME CONTENT PRESENTATIONS

(75) Inventors: Mark B. Gagner, West Chicago, IL (US); Timothy C. Loose, Chicago, IL (US); Brian D. Manning, Las Vegas, NV (US); Scott A. Massing, Lincolnwood, IL (US); Jesse M. Smith, Chicago, IL (US); Alfred Thomas, Las Vegas, NV (US)

(73) Assignee: WMS Gaming, Inc, Waukegan, IL (US)

( * ) Notice: Subject to any disclaimer, the term of this patent is extended or adjusted under 35 U.S.C. 154(b) by 0 days.

(21) Appl. No.: 13/295,040

(22) Filed: Nov. 11, 2011

Related U.S. Application Data

(60) Provisional application No. 61/412,899, filed on Nov. 12, 2010.

(51) Int. Cl.
*A63F 9/00* (2006.01)

(52) U.S. Cl.
USPC ..... 463/25

(58) Field of Classification Search
None
See application file for complete search history.

(56) References Cited

U.S. PATENT DOCUMENTS

| | | | | |
|---|---|---|---|---|
| 4,371,164 | A | 2/1983 | Halliburton | |
| 5,287,437 | A * | 2/1994 | Deering | 345/427 |
| 6,504,649 | B1 * | 1/2003 | Myers | 359/454 |
| 6,842,183 | B2 | 1/2005 | Higashiyama et al. | |
| 6,863,609 | B2 | 3/2005 | Okuda et al. | |
| 6,866,585 | B2 | 3/2005 | Muir | |
| 6,887,157 | B2 | 5/2005 | LeMay et al. | |
| 7,278,920 | B1 * | 10/2007 | Klamer et al. | 463/34 |
| 7,465,230 | B2 | 12/2008 | LeMay et al. | |
| 7,572,186 | B2 | 8/2009 | LeMay et al. | |
| 7,775,876 | B2 | 8/2010 | Rowe | |
| 7,841,944 | B2 | 11/2010 | Wells | |
| 7,901,289 | B2 | 3/2011 | Schlottmann et al. | |
| 7,934,994 | B2 | 5/2011 | LeMay et al. | |
| 8,002,623 | B2 | 8/2011 | Resnick et al. | |

(Continued)

FOREIGN PATENT DOCUMENTS

| | | |
|---|---|---|
| EP | 1180384 | 2/2002 |
| KR | 1020020013751 | 2/2002 |

(Continued)

OTHER PUBLICATIONS

U.S. Appl. No. 13/447,210, filed Apr. 14, 2012, Gronkowski, Timothy T., et al.

*Primary Examiner* — Melba Bumgarner
*Assistant Examiner* — Seng H Lim
(74) *Attorney, Agent, or Firm* — DeLizio Gilliam, PLLC

(57) ABSTRACT

A wagering game system and its operations are described herein. In some embodiments, the operations can include determining a number of distinct channels of images associated with 3D wagering game content to present sequentially in a common display of the wagering game system during a corresponding number of sequential time slots based, at least in part, on a number of active shutter 3D glasses of the wagering game system that have been initiated. The operations can also include transmitting a synchronization signal to the active shutter 3D glasses to synchronize lens film activation operations with the presentation of the distinct channels of images in the common display. The operations can further include sequentially presenting the distinct channels of images associated with the 3D wagering game content in the common display during the corresponding number of sequential time slots according to a timing of the synchronization signal.

20 Claims, 11 Drawing Sheets

(56) References Cited

U.S. PATENT DOCUMENTS

| | | | | |
|---|---|---|---|---|
| 8,079,905 | B2 * | 12/2011 | Nguyen et al. | 463/29 |
| 8,159,526 | B2 * | 4/2012 | Sato et al. | 348/51 |
| 8,269,822 | B2 * | 9/2012 | Zalewski | 348/56 |
| 2002/0003537 | A1 | 1/2002 | Higashiyama et al. | |
| 2002/0022518 | A1 | 2/2002 | Okuda et al. | |
| 2003/0032479 | A1 | 2/2003 | LeMay et al. | |
| 2004/0198505 | A1 | 10/2004 | Hatakeda | |
| 2004/0214630 | A1 * | 10/2004 | Mayeroff | 463/20 |
| 2005/0059479 | A1 | 3/2005 | Soltys et al. | |
| 2005/0233799 | A1 | 10/2005 | LeMay et al. | |
| 2006/0014577 | A1 * | 1/2006 | Snow | 463/12 |
| 2006/0061652 | A1 * | 3/2006 | Sato et al. | 348/53 |
| 2006/0094510 | A1 * | 5/2006 | Risso et al. | 463/46 |
| 2006/0287058 | A1 | 12/2006 | Resnick | |
| 2011/0230268 | A1 | 11/2007 | Williams et al. | |
| 2007/0281780 | A1 | 12/2007 | Aida | |
| 2008/0015004 | A1 * | 1/2008 | Gatto et al. | 463/16 |
| 2008/0024597 | A1 * | 1/2008 | Yang et al. | 348/53 |
| 2008/0045331 | A1 | 2/2008 | LeMay et al. | |
| 2008/0108426 | A1 * | 5/2008 | Nguyen et al. | 463/25 |
| 2008/0113745 | A1 | 5/2008 | Williams et al. | |
| 2008/0113775 | A1 | 5/2008 | Williams et al. | |
| 2008/0125219 | A1 | 5/2008 | Williams et al. | |
| 2008/0303746 | A1 | 12/2008 | Schlottmann et al. | |
| 2009/0062001 | A1 | 3/2009 | LeMay et al. | |
| 2009/0227371 | A1 | 9/2009 | Visser | |
| 2010/0007582 | A1 * | 1/2010 | Zalewski | 345/8 |
| 2011/0018867 | A1 | 1/2011 | Shibamiya et al. | |
| 2011/0018868 | A1 | 1/2011 | Inoue et al. | |
| 2011/0201404 | A1 | 8/2011 | Wells | |
| 2011/0255019 | A1 * | 10/2011 | Son | 349/15 |
| 2012/0190439 | A1 * | 7/2012 | Nourbakhsh | 463/31 |
| 2012/0194656 | A1 * | 8/2012 | Killian | 348/56 |

FOREIGN PATENT DOCUMENTS

| | | |
|---|---|---|
| WO | WO-2005034054 | 4/2005 |
| WO | WO-2008063914 | 5/2008 |
| WO | WO-2008063968 | 5/2008 |
| WO | WO-2008066196 | 6/2008 |
| WO | WO-2008079542 | 7/2008 |
| WO | WO-2008154433 | 12/2008 |
| WO | WO-2009009224 | 1/2009 |
| WO | WO-2009009225 | 1/2009 |
| WO | WO-2011142399 | 11/2011 |

* cited by examiner

210

| | 1ST TIME SLOT | 2ND TIME SLOT | 3RD TIME SLOT | 4TH TIME SLOT |
|---|---|---|---|---|
| DISPLAY 170 | IMAGE ONE LEFT EYE | IMAGE TWO LEFT EYE | IMAGE ONE RIGHT EYE | IMAGE TWO RIGHT EYE |
| GLASSES 165A RIGHT LENS FILM | OFF | OFF | ON | OFF |
| GLASSES 165A LEFT LENS FILM | ON | OFF | OFF | OFF |
| GLASSES 165B RIGHT LENS FILM | OFF | OFF | OFF | ON |
| GLASSES 165B LEFT LENS FILM | OFF | ON | OFF | OFF |
| GLASSES 165A VIEW | IMAGE ONE LEFT | OFF | IMAGE ONE RIGHT | OFF |
| GLASSES 165B VIEW | OFF | IMAGE TWO LEFT | OFF | IMAGE TWO RIGHT |

FIG. 2A

220

COMPLEMENTARY IMAGE CANCELLATION TECHNIQUE

| | | 1ST TIME SLOT | 2ND TIME SLOT | 3RD TIME SLOT | 4TH TIME SLOT |
|---|---|---|---|---|---|
| DISPLAY 170 | | IMAGE ONE LEFT EYE | IMAGE ONE RIGHT EYE | COMPLEMENTARY IMAGE ONE LEFT EYE | COMPLEMENTARY IMAGE ONE RIGHT EYE |
| GLASSES 165A RIGHT LENS FILM | | OFF | ON | OFF | OFF |
| GLASSES 165A LEFT LENS FILM | | ON | OFF | OFF | OFF |
| WITH GLASSES 165A | LEFT EYE VIEW | IMAGE ONE LEFT EYE | OFF | OFF | OFF |
| | RIGHT EYE VIEW | OFF | IMAGE ONE RIGHT EYE | OFF | OFF |
| | WITHOUT GLASSES | IMAGE ONE LEFT EYE | IMAGE ONE RIGHT EYE | COMPLEMENTARY IMAGE ONE LEFT EYE | COMPLEMENTARY IMAGE ONE RIGHT EYE |

FIG. 2B

410

| | 1ST TIME SLOT | 2ND TIME SLOT | 3RD TIME SLOT | 4TH TIME SLOT |
|---|---|---|---|---|
| DISPLAY 361A | IMAGE 1 LEFT EYE | IMAGE 1.1 LEFT EYE | IMAGE 1 RIGHT EYE | IMAGE 1.1 RIGHT EYE |
| DISPLAY 361B | IMAGE 2.1 LEFT EYE | IMAGE 2 LEFT EYE | IMAGE 2.1 RIGHT EYE | IMAGE 2 RIGHT EYE |
| DISPLAY 370 | IMAGE 3 LEFT EYE | | IMAGE 3 RIGHT EYE | |
| GLASSES 365A RIGHT EYE FILM | OFF | OFF | ON | OFF |
| GLASSES 365A LEFT EYE FILM | ON | OFF | OFF | OFF |
| GLASSES 365B RIGHT EYE FILM | OFF | OFF | OFF | ON |
| GLASSES 365B LEFT EYE FILM | OFF | ON | OFF | OFF |
| PLAYER 1 VIEWING DISPLAY 361A | IMAGE 1 LEFT | OFF | IMAGE 1 RIGHT | OFF |
| PLAYER 1 VIEWING DISPLAY 361B | IMAGE 2.1 LEFT | OFF | IMAGE 2.1 RIGHT | OFF |
| PLAYER 1 VIEWING DISPLAY 370 | IMAGE 3 LEFT | OFF | IMAGE 3 RIGHT | OFF |
| PLAYER 2 VIEWING DISPLAY 361A | OFF | IMAGE 2 LEFT | OFF | IMAGE 2 RIGHT |
| PLAYER 2 VIEWING DISPLAY 361B | OFF | IMAGE 1.1 LEFT | OFF | IMAGE 1.1 RIGHT |
| PLAYER 2 VIEWING DISPLAY 370 | OFF | IMAGE 3 LEFT | OFF | IMAGE 3 RIGHT |

FIG. 4

610

| | 1ST TIME SLOT | 2ND TIME SLOT | 3RD TIME SLOT | 4TH TIME SLOT |
|---|---|---|---|---|
| DISPLAY 361A | IMAGE 1 LEFT EYE | IMAGE 1.1 LEFT EYE | IMAGE 1 RIGHT EYE | IMAGE 1.1 RIGHT EYE |
| DISPLAY 361B | IMAGE 2 LEFT EYE | IMAGE 2.1 LEFT EYE | IMAGE 2 RIGHT EYE | IMAGE 2.1 RIGHT EYE |
| DISPLAY 361C | IMAGE 3 LEFT EYE | IMAGE 3.1 LEFT EYE | IMAGE 3 RIGHT EYE | IMAGE 3.1 RIGHT EYE |
| DISPLAY 361D | IMAGE 4 LEFT EYE | IMAGE 4.1 LEFT EYE | IMAGE 4 RIGHT EYE | IMAGE 4.1 RIGHT EYE |
| DISPLAY 370 | IMAGE 5 LEFT EYE | IMAGE 6 LEFT EYE | IMAGE 5 RIGHT EYE | IMAGE 6 RIGHT EYE |
| PRIMARY USER RIGHT EYE FILM | OFF | OFF | ON | OFF |
| PRIMARY USER LEFT EYE FILM | ON | OFF | OFF | OFF |
| SECONDARY USER RIGHT EYE FILM | OFF | OFF | OFF | ON |
| SECONDARY USER LEFT EYE FILM | OFF | ON | OFF | OFF |
| PRIMARY USER VIEW OWN DISPLAY | IMAGE X LEFT | OFF | IMAGE X RIGHT | OFF |
| PRIMARY USER VIEW OTHER DISPLAY | IMAGE X LEFT | OFF | IMAGE X RIGHT | OFF |
| PRIMARY USER VIEW DISPLAY 370 | IMAGE 5 LEFT | OFF | IMAGE 5 RIGHT | OFF |
| SECONDARY USER VIEW OWN DISPLAY | OFF | IMAGE X.1 LEFT | OFF | IMAGE X.1 RIGHT |
| SECONDARY USER VIEW OTHER DISPLAY | OFF | IMAGE X.1 LEFT | OFF | IMAGE X.1 RIGHT |
| SECONDARY USER VIEW DISPLAY 370 | OFF | IMAGE 6 LEFT | OFF | IMAGE 6 RIGHT |

FIG. 6

COORDINATING THREE DIMENSIONAL WAGERING GAME CONTENT PRESENTATIONS

RELATED APPLICATIONS

This application claims the priority benefit of U.S. Provisional Application Ser. No. 61/412,899 filed Nov. 12, 2010.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2011, WMS Gaming, Inc.

FIELD

Embodiments of the inventive subject matter relate generally to wagering game systems, and more particularly to coordinating three dimensional (3D) wagering game content presentations in wagering game systems.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

BRIEF DESCRIPTION OF THE FIGURES

Embodiments are illustrated in the Figures of the accompanying drawings in which:

FIGS. 2A and 2B are example timing diagrams that illustrate coordinating the presentation of 3D wagering game content in a common display for multiple players, according to some embodiments;

FIG. 4 is an example timing diagram that illustrates coordinating the presentation of 3D wagering game content in a plurality of wagering game machines and in a common display for multiple players, according to some embodiments;

FIG. 6 is another example timing diagram that illustrates coordinating the presentation of 3D wagering game content in a plurality of wagering game machines and in a common display for multiple players, according to some embodiments;

DESCRIPTION OF THE EMBODIMENTS

This description of the embodiments is divided into five sections. The first section provides an introduction to some embodiments, while the second section describes example wagering game machine architectures. The third section describes example operations performed by some embodiments and the fourth section describes example wagering game machines in more detail. The fifth section presents some general comments.

Introduction

This section provides an introduction to some embodiments.

Wagering game systems offer wagering game players ("players") entertainment value and the opportunity to win monetary value. In various embodiments, wagering game systems can try to enhance the gaming experience by offering players the opportunity to play wagering games with three-dimensional (3D) game content. For example, wagering game machines can be configured to present 3D secondary wagering games (e.g. individual or community bonus games). Wagering game machines can also be configured to present both 3D base wagering games (e.g., 3D video slots or 3D video poker) and three-dimensional secondary wagering games. In some embodiments, a bank of related wagering game machines including a common display (e.g., a bank overhead display) can be configured to utilize active shutter 3D glasses to coordinate the presentation of 3D wagering games (e.g., secondary wagering games) in the bank overhead display for multiple players, as will be further described with reference to FIGS. 1-2B, and 7-8. It is noted, however, that in other embodiments a single wagering game machine be configured to utilize active shutter 3D glasses to coordinate the presentation of 3D wagering games in a single display for a single player or for multiple players. In some embodiments, a bank of related wagering game machines including a bank overhead display can be configured to utilize active shutter 3D glasses to coordinate the presentation of 3D wagering games (base and/or secondary wagering games) in the display (s) of each wagering game machine and in the bank overhead display for multiple players, as will be further described with reference to FIGS. 3-7 and 9.

Figure 1:
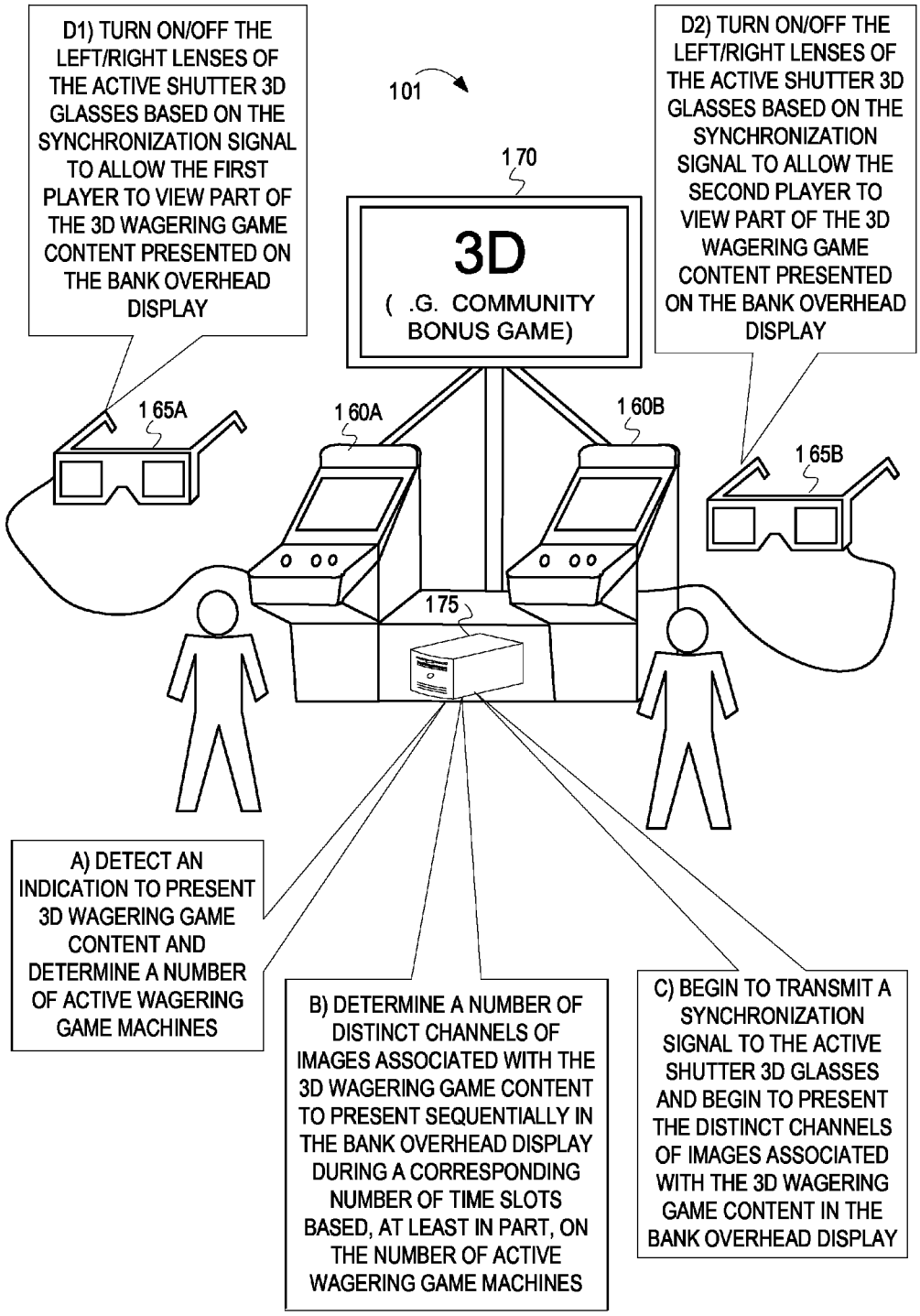
FIG. 1 is a conceptual diagram illustrating an example wagering game system for coordinating the presentation of 3D wagering game content in a common display for multiple players, according to some embodiments.

FIG. 1 is a conceptual diagram illustrating an example wagering game system for coordinating the presentation of 3D wagering game content in a common display for multiple players, according to some embodiments. In the example shown in FIG. 1, the wagering game system 101 comprises a bank of wagering game machines 160A and 160B, active shutter 3D glasses 165A and 165B, a bank overhead display 170, and a bank game controller 175. It is noted, however, that in other implementations the wagering game system 101 may comprise more than two wagering game machines 160 and a corresponding number of active shutter 3D glasses (e.g., four wagering game machines with four active shutter 3D glasses). Furthermore, in other implementations, the wagering game system 101 may be configured for a single player or multiple players; for example, the wagering game system 101 may comprise a single wagering game machine 160, one or more active shutter 3D glasses 165, a bank overhead display 170, and a bank game controller 175.

At stage A, the bank game controller 175 detects an indication to present 3D wagering game content in the wagering game system 101 and determines the number of wagering game machines 160 that are active. In one implementation, the bank game controller 175 can detect an indication (e.g., receive a message, read a status bit or configuration register, etc.) to present a 3D secondary wagering game (e.g., a 3D community bonus game) in the bank overhead display 170 of the system 101. For example, the 3D secondary wagering game can be triggered in response to detecting on one or more game-related trigger events (e.g., a big win, a predefined number of maximum bets, etc.) associated with the base wagering game(s) being played on the wagering game machines 160A and 160B. In another implementation, the bank game controller 175 can detect an indication to present 3D wagering game content on the bank overhead display 170 when the players log in to the wagering game machines 160A and 160B. For example, the bank game controller 175 can detect that a wagering game machine 160 has changed state from an idle state to an active state when a player logs in to the wagering game machine (e.g., by inserting a player card in a card reader, entering a player username and password, biometric login, etc.). In the example of shown in FIG. 1, the bank game controller 175 can determine that both the wagering game machines 160A and 160B are active, and therefore determine that the corresponding pairs of active shutter 3D glasses 165A and 165B can be used to view the 3D wagering game content. It is noted, however, that in other examples only one wagering game machine 165 (and the corresponding pair of active shutter 3D glasses) may be active, or in systems with more than two wagering game machines, three or more wagering game machines may be active.

At stage B, the bank game controller 175 determines the number of distinct channels of images associated with the 3D wagering game content to present sequentially in the bank overhead display 170 (or common overhead display) during a corresponding number of sequential time slots based, at least in part, on the number of active wagering game machines 160. In some examples, each channel of images can comprise images that are displayed sequentially in rapid succession in a display (e.g., at the display's refresh rate or at a fraction of the refresh rate). In one implementation, based on the number of active wagering game machines 160 (and the corresponding pairs of active shutter 3D glasses 165), the bank game controller 175 determines the number of distinct channels of images that should be presented according to an alternate frame sequencing technique in the bank overhead display 170 to allow the players to view the 3D wagering game content (3D video) with the active shutter 3D glasses 165. In the example shown in FIG. 1, the bank game controller 175 determines to present two distinct channels of related images (i.e., one distinct channel for the left eye and another distinct channel for the right eye) for each pair of active shutter 3D glasses 165 (for a total of four distinct channels of images) according to an alternate frame sequencing technique in the bank overhead display 170 to allow each player to view different 3D wagering game content using the corresponding pair of active shutter 3D glasses 165 during the four sequential time slots. The two distinct channels of related images intended to be viewed by the left eye and right eye, respectively, of the first player are presented in the bank overhead display 170 such that when viewed with the active shutter 3D glasses 165A the first player sees the 3D wagering game content (3D video) intended for the first player. The two distinct channels of related images intended to be viewed by the left eye and right eye, respectively, of the second player are also presented in the bank overhead display 170 such that when viewed with the active shutter 3D glasses 165B the second player sees the 3D wagering game content (3D video) intended for the first player, as will be further described below. In some implementations, one or more additional channels (and a corresponding number of time slots) may be needed to implement techniques such as complementary image cancellation, as will be further described below.

At stage C, the bank game controller 175 begins transmitting a synchronization signal to the active shutter 3D glasses 165A and 165B, and also begins presenting the distinct channels of images associated with the 3D wagering game content in the bank overhead display 170. The synchronization signal is transmitted to synchronize the operation of the active shutter 3D glasses 165 with the presentation of the distinct channels of images associated with the 3D wagering game content in the bank overhead display 170. In one example, as shown in timing diagram 210 of FIG. 2A, the bank game controller 175 can cause the bank overhead display 170 to continuously and sequentially present image one from channel one intended to be viewed by the left eye of the first player wearing the glasses 165A during a first time slot, then present image two from channel two intended to be viewed by the left eye of the second player wearing the glasses 165B during a second time slot, then present image one from channel three intended to be viewed by the right eye of the first player wearing the glasses 165A during a third time slot, and finally present image two from channel four intended to be viewed by the right eye of the second player wearing the glasses 165B during a fourth time slot. The synchronization signal can synchronize the turning on/off of the left/right lens films of the active shutter 3D glasses 165 with the presentation of the images, as will be further described below.

Furthermore, concurrently and continuously with stage C, the operation of each of the active shutter 3D glasses 165 is synchronized (based on the synchronization signal) at stages D1 and D2. At stage D1, the active shutter 3D glasses 165A continuously turn on/off the left/right lens films based on the timing of the synchronization signal to allow the first player to view the 3D wagering game content (3D video) intended for the first player. Concurrently, at stage D2, the active shutter 3D glasses 165B continuously turn on/off the left/right lens films based on the timing of the synchronization signal to allow the second player to view the 3D wagering game content (3D video) intended for the second player. For instance, in the example shown in FIG. 2A, the left lens film of the glasses 165A is turned on during the first time slot so that the left eye of the first player wearing the glasses 165A can view image one from channel one that is presented in the bank overhead display 170 during the first time slot. The right lens film of the glasses 165A and both the left/right lens films of the glasses 165B are turned off during the first time slot. Similarly, during the second time slot, the left lens film of the glasses 165B is turned on so that the left eye of the second player wearing the glasses 165B can view image two from channel two that is presented in the bank overhead display 170 during the second time slot. Both the left/right lens films of the glasses 165A and the right lens film of the glasses 165B are turned off during the second time slot. During the third time slot, the right lens film of the glasses 165A is turned on so that the right eye of the first player wearing the glasses 165A can view image one from channel three that is presented in the bank overhead display 170 during the third time slot. The left lens film of the glasses 165 and both the left/right lens films of the glasses 165B are turned off during the third time slot. During the fourth time slot, the right lens film of the glasses 165B is turned on so that the right eye of the second player wearing the glasses 165B can view image two from channel four that is presented in the bank overhead display 170 during the fourth time slot. Both the left/right lens films of the glasses 165A and the left lens film of the glasses 165B are turned off during the fourth time slot. In this example, image one from channel one and image one from channel three are different but related images (e.g., images showing the same content from a different perspective) such that when viewed with the active shutter 3D glasses 165A the first player sees the content associated with image one in 3D during the time period comprising the four time slots. Similarly, image two from channel two and image two from channel four are different but related images such that when viewed with the active shutter 3D glasses 165B the second player sees the content associated with image two in 3D during the time period comprising the four time slots. Furthermore, by turning on/off the glasses 165, the first player will not be able to see the image intended for the second player (i.e., image two) and the second player will not be able to see the image intended for the first player (i.e., image one). In some 3D wagering games, a player could gain an unfair advantage if the player could see the 3D wagering game content that is intended for the other player(s). For example, in a 3D community bonus game, the players are presented with 3D game content or elements (e.g., ghosts) that fly out of the display. In this example, different ghosts can be presented to the different players, and therefore a player could gain an unfair advantage if the player could see the other ghosts that were intended to be viewed only by the other players.

In one implementation, the active shutter 3D glasses 165 can include special type of lenses which include liquid crystal shutters which have the property of becoming dark or opaque when a voltage is applied, and being transparent when a voltage is not applied. The lens film can be characterized to be "on" when the lens film is transparent and "off" when the lens film is opaque. In one example, the synchronization signal can control when the voltage is applied to the left or right lens films to synchronize the turning on/off of the lens films with the presentation of the images on the bank overhead display 170. It is noted, however, that in other implementations other types of 3D glasses can be used that have lenses that can be turned on/off according to the timing of a synchronization signal (or other similar triggers/timers) to allow the player to view the 3D wagering game content.

In the example timing diagram 210 shown in FIG. 2A, if the refresh rate associated with the bank overhead display 170 is 240 Hz, since the refresh rate is divided between the four channels that present distinct images during the four time slots, each eye of each player is "on" 25% of the time and therefore effectively sees one fourth the refresh rate or 60 Hz. If the refresh rate associated with the bank overhead display is 120 Hz, then each eye of each player would effectively see a refresh rate of 30 Hz.

Figure 7:
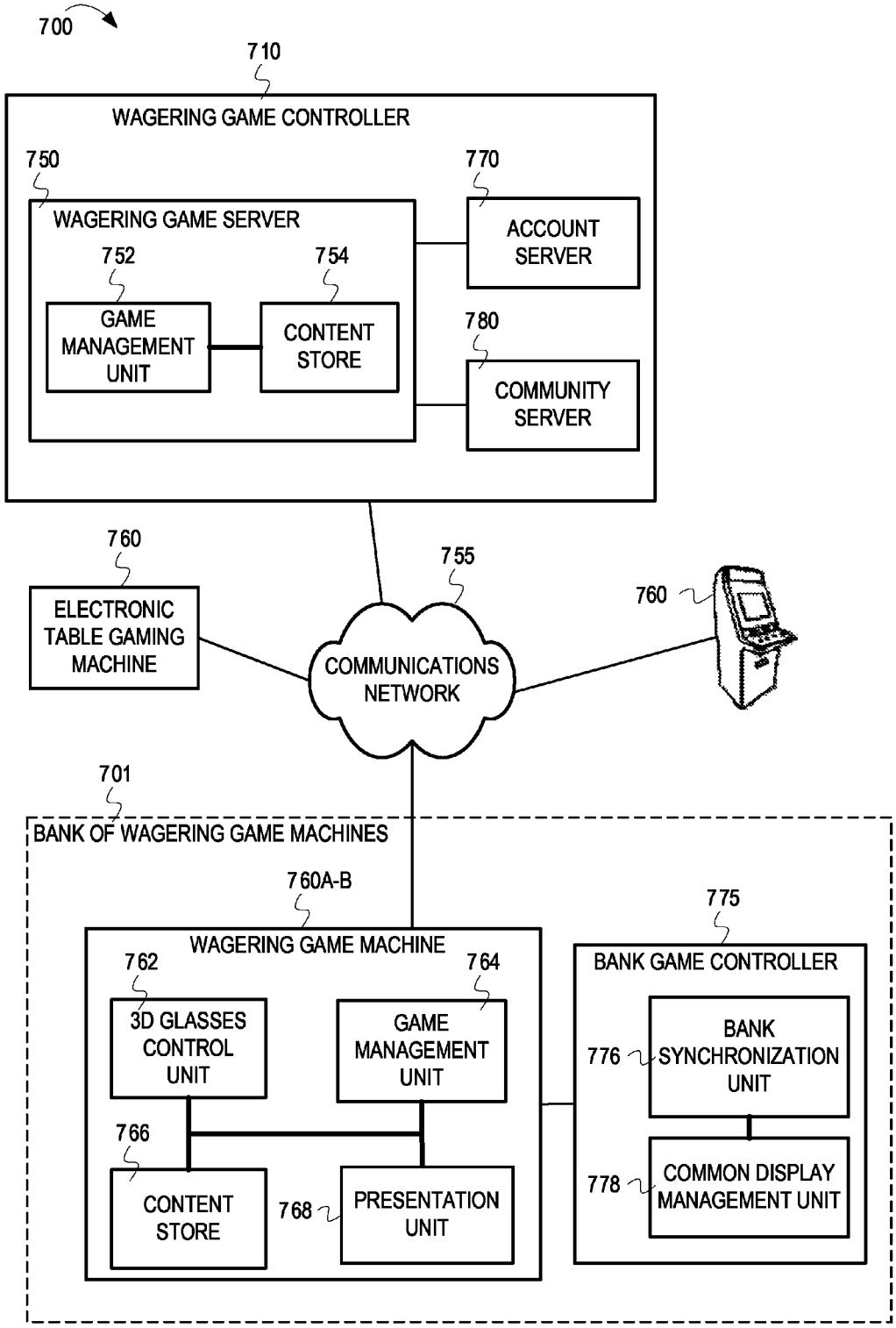
FIG. 7 is a conceptual diagram that illustrates an example of a wagering game system architecture, according to some embodiments.

In one implementation, the synchronization signal can be generated based on one or more timers (or other similar mechanisms) that are implemented at the bank game controller 175 that are used for synchronizing the presentation of the distinct channels of images during the different time slots. For example, the one or more timers can be used by the hardware/software in the video card included in the bank game controller 175 for presenting the 3D game content on the bank overhead display 170. One example block diagram of the bank game controller 175 is shown in FIG. 7 (and described below). In one implementation, the one or more timers that are used to generate the synchronization signal can be implemented by the bank synchronization unit 776 of the bank game controller 175.

If one of the players takes off the glasses 165 during the time period associated with the four time slots, the player will see the images from all four channels superimposed on each other and, in some cases, additional noise. By removing the glasses 165, some players may be able to discern the superimposed images to gain an unfair advantage in the 3D wagering games (e.g., by viewing the content that was only intended for the other players). In some cases, the superimposed images and resulting noise may not be visually pleasing to bystanders or other potential players. Therefore, in some embodiments, as shown in the timing diagram 220 of FIG. 2B, the bank game controller 175 can implement image cancellation techniques to add one additional channel of complementary images for each eye of each player to suppress the content that is viewed in the bank overhead display 170 without the glasses 165. The additional channel of complementary images can be a negative (e.g., brightness complement) of the corresponding channel of images such that when the images are superimposed the resulting image is a solid gray image. For example, an image of a black letter A with a yellow (100% red, 100% green, 0% blue) background superimposed with an image of a white letter A with a blue (0% red, 0% green, 100% blue) background results in an image of a 50% gray background. The timing diagram 220 of FIG. 2B illustrates this technique for a single player (e.g., the first player of FIG. 1 wearing the glasses 165A). As shown, if the first player is wearing the glasses 165A during the four time slots shown in FIG. 2B, the first player will see image one in 3D, because both the left and right lens films of the glasses 165A will be off when the complementary images are presented. However, if the first player takes off the glasses 165A during the four time slots, image one left and image one right will mix with the complementary image one left and the complementary image one right such that the first player will see the 50% gray background. Similarly, if the second player takes off the glasses 165B, the second player will see the 50% gray background, or if a bystander looks up at the bank overhead display 170, the bystander will see the 50% gray background.

In some implementations, a "watermark" can be added instead of having a resultant image that is a plain 50% gray background when not wearing the active shutter 3D glasses. For example, adding a watermark to each complementary image would result in the watermark image superimposed on the 50% grey background. However, any portion of the input image that is fully saturated white cannot be made darker than 50% grey on the resultant image, and any portion of the input image that is fully saturated black cannot be made lighter than 50% grey on the resultant image. In some implementations, the active shutter 3D glasses 165 can be combined with circular polarization separation to improve the effectiveness of the complementary image cancellation technique (e.g., reduce image flickering, temporal image, and/or image drifting).

In some implementations, instead of implementing the complementary noise cancellation technique, a single channel of noise can be added that comprises images that are much brighter (i.e., the noise) than the images that are presented in the other channels of 3D wagering game content. The brighter images of the noise channel can overwhelm the other images of the 3D wagering game content and therefore reduce the likelihood of players discerning the different channels of 3D wagering game content to gain an advantage in the 3D wagering game. In some examples, the channel of noise can comprise images that form predefined video patterns and/or random images that add chaos to the display to reduce the likelihood of players discerning the different channels of 3D wagering game content. In other examples, two or more noise channels can be added.

It is noted, however, that in other implementations the bank game controller 175 can present the same 3D wagering game content on the bank overhead display 170 to both the first and second players. For example, the bank game controller 175 can sequentially and continuously present two distinct channels of related images (i.e., one channel for the left eyes and the other channel for the right eyes of both players) on the bank overhead display 170 during two sequential time slots such that when viewed with the active shutter 3D glasses 165 both players see the same 3D wagering game content. In this example, both pairs of active shutter 3D glasses 165 turn on/off the left/right lens films at the same time (during the same time slots) based on the synchronization signal so the players see the same 3D wagering game content. In yet another implementation, the bank game controller 175 can sequentially and continuously present two distinct channels of images to present different two dimensional (2D) wagering game content to each of the players. In this implementation, a first distinct channel of images intended to be viewed by the first player is presented during the first time slot, and both the left and right lens films of the glasses 165A are turned on/off at the same time (e.g., turned on during the first time slot and turned off during the second time slot) such that the first player sees the 2D wagering game content intended for the first player. Also, in this implementation, a second distinct channel of images intended to be viewed by the second player is presented during the second time slot, and both the left and right lens films of the glasses 165B are turned on/off at the same time (e.g., turned on during the second time slot and turned off during the first time slot) such that the second player sees the 2D wagering game content intended for the second player.

Figure 3:
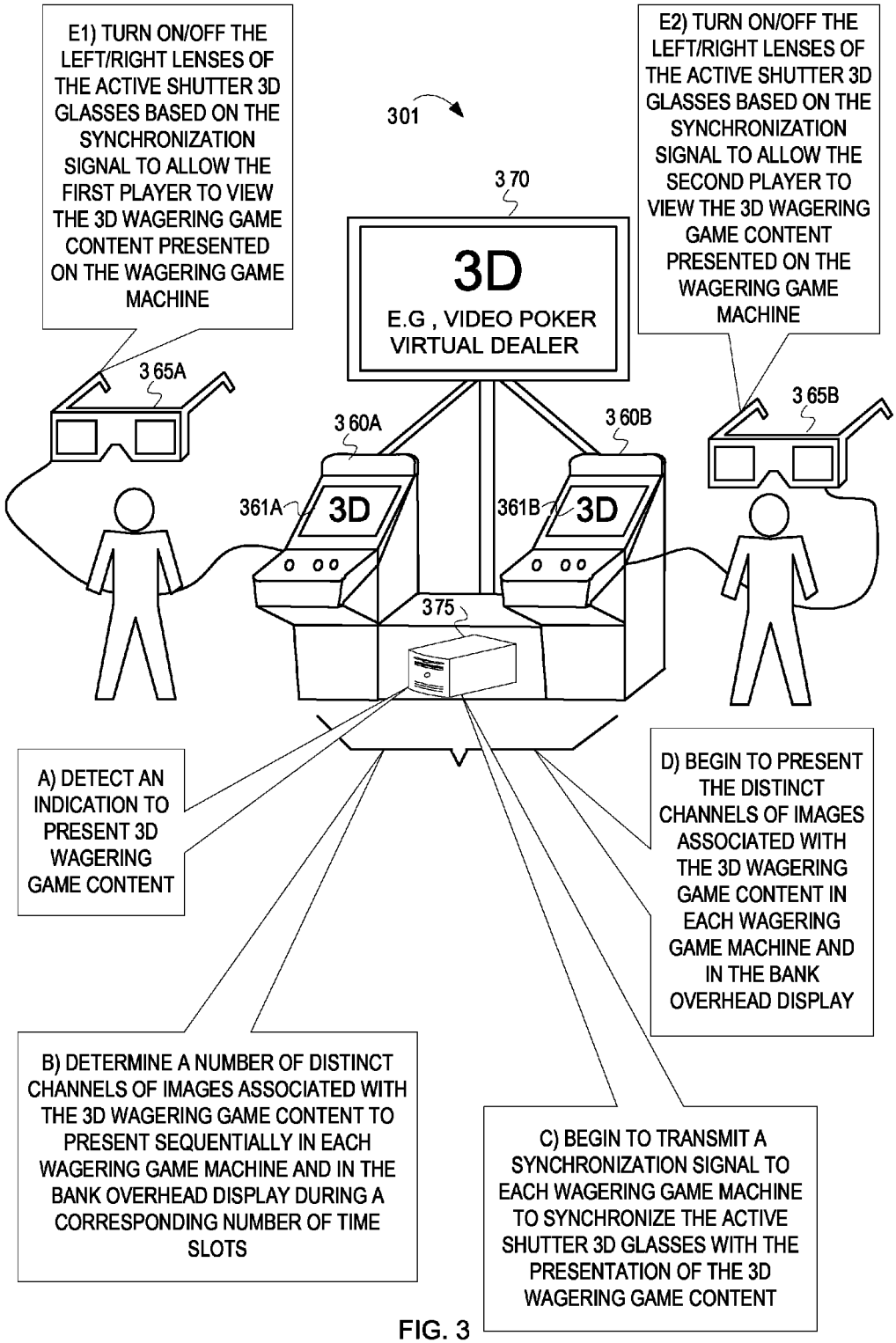
FIG. 3 is a conceptual diagram illustrating an example wagering game system for coordinating the presentation of 3D wagering game content in a plurality of wagering game machines and in a common display for multiple players, according to some embodiments.
Figure 5:
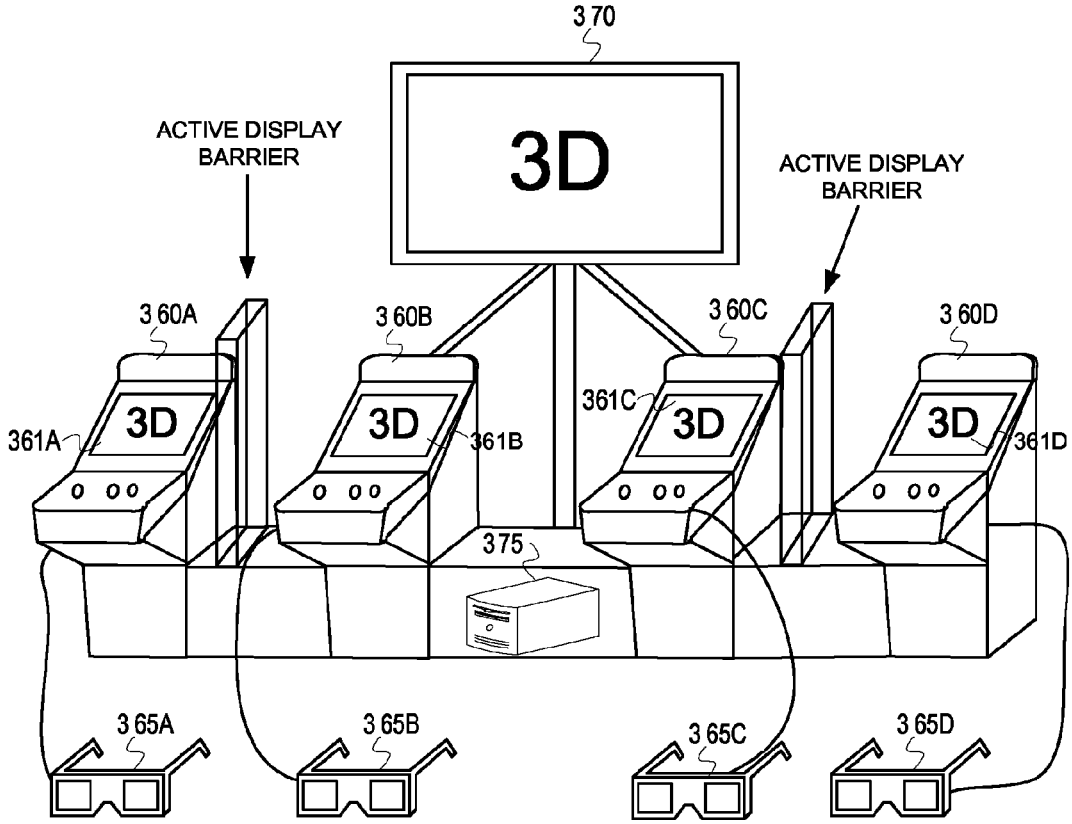
FIG. 5 is a conceptual diagram illustrating another example wagering game system for coordinating the presentation of 3D wagering game content in a plurality of wagering game machines and in a common display for multiple players, according to some embodiments.

FIG. 3 is a conceptual diagram illustrating an example wagering game system for coordinating the presentation of 3D wagering game content in a plurality of wagering game machines and in a common display for multiple players, according to some embodiments. In the example shown in FIG. 3, the wagering game system 301 comprises a bank of wagering game machines 360A and 360B, active shutter 3D glasses 365A and 365B, a bank overhead display 370, and a bank game controller 375. In FIG. 3, instead of presenting the 3D wagering game content (during different time slots) intended for all the players on the bank overhead display (as described in FIG. 1), the 3D wagering game content intended for each player is presented in at least one of the displays of each player's wagering game machine 360 and the community wagering game content (or other community gaming-related content) is presented on the bank overhead display 370. For example, the system 301 can present a base wagering game such as a 3D video poker or blackjack game. In this example, the bank overhead display 370 can display 3D content of a virtual dealer (community content), and each wagering game machine 360 can display 3D content of each player's cards and chips (personal content). In another example, the system 301 can present 3D slots games in each of the player's wagering game machines 360, and can present 3D community bonus games, base game-related statistics, and/or virtual community gaming content on the bank overhead display 370. In some examples, when a 3D community bonus game is triggered in the system 301, the 3D community bonus game content can be displays only in the bank overhead display 370 or, in other examples, the 3D community bonus game content can be displays in both the wagering game machines 360 and in the bank overhead display 370. It is noted, however, that the system 301 can be configured to implement the techniques described herein to present 3D wagering game content in various other presentation schemes to accommodate other types of 3D wagering games. It is further noted that in other implementations the wagering game system 301 may comprise more than two wagering game machines 360 and a corresponding number of active shutter 3D glasses (e.g., four wagering game machines with four active shutter 3D glasses, as shown in FIG. 5).

At stage A, the bank game controller 375 detects an indication to present 3D wagering game content in the wagering game system 301. In one implementation, the bank game controller 375 can detect an indication (e.g., receive a message, read a status bit or configuration register, etc.) to present a 3D base wagering game and/or a 3D secondary wagering game (e.g., a 3D community bonus game) in the wagering game machines 360A and 360B, and in the bank overhead display 370 of the system 301. Similarly as described in FIG. 1, the bank game controller 375 can detect the indication when the players log in to the system 301, or when a secondary wagering game is triggered.

At stage B, each of the wagering game machines 360 determines the number of distinct channels of images associated with the 3D wagering game content to present sequentially in at least one of the displays of the wagering game machine 360 during a corresponding number of sequential time slots. Furthermore, the bank game controller 375 determines the number of distinct channels of images associated with the 3D wagering game content to present sequentially in the bank overhead display 370 (or common overhead display) during the corresponding number of sequential time slots. In one implementation, each wagering game machine 360 determines the number of distinct channels of images that should be presented according to an alternate frame sequencing technique to allow the players to view the 3D wagering game content with the active shutter 3D glasses 365 in the wagering game machines 360. The bank game controller 375 also determines the number of distinct channels of images that should be presented according to an alternate frame sequencing technique to allow the players to view the 3D wagering game content with the active shutter 3D glasses 365 in the bank overhead display 370.

In some implementations, each wagering game machine 360 can be configured to sequentially present two distinct channels of related images (i.e., one for each eye of the player) during two sequential time slots such that when viewed with the active shutter 3D glasses 365 the player sees the 3D wagering game content 3D video) intended for the player. In some implementations, each wagering game machine 360 can be configured to implement an image injection technique to present two additional distinct channels of images (for a total of four channels) during two additional time slots (for a total of four sequential time slots) such that players at adjacent wagering game machines (e.g., machines 365A and 365B) are prevented from viewing the other player's 3D wagering game content, as will be further described below with reference to the timing diagram 410 of FIG. 4.

In the example timing diagram 410 shown in FIG. 4, the wagering game machines 360 implement an image injection technique to prevent players at adjacent wagering game machines from viewing each other's 3D wagering game content. As shown in FIG. 4, the display 361A of the wagering game machine 360A presents image one from channel one intended to be viewed by the left eye of the first player wearing the glasses 365A during a first time slot, and image one from channel three intended to be viewed by the right eye of the first player wearing the glasses 365A during a third time slot. The wagering game machine 360A presents the related image one from channel one and image one from channel three during the time slots when the corresponding left/right lens film of the active shutter 3D glasses 365A will be on. During the second and fourth time slots when the first player's active shutter 3D glasses 365A will be off, the wagering game machine 360A presents additional 3D content intended to be viewed by the second player at the adjacent wagering game machine 360B if the second player glances over from the wagering game machine 360B while wearing the active shutter 3D glasses 365B. As shown in FIG. 4, the additional 3D content is image 1.1 from channel two intended to be viewed by the left eye of the second player during the second time slot (when the left lens film of the glasses 365B is on), and image 1.1 from channel four intended to be viewed by the right eye of the second player during the fourth time slot (when the right lens film of the glasses 365B is on) if the second player glances over from the adjacent wagering game machine 360B. Similarly, the display 361B of the wagering game machine 360B presents image 2 from channel two intended to be viewed by the left eye of the second player wearing the glasses 365B during a second time slot, and image 2 from channel four intended to be viewed by the right eye of the second player wearing the glasses 365B during a fourth time slot. The additional 3D content presented in the display 361B of the wagering game machine 360B is image 2.1 from channel one intended to be viewed by the left eye of the first player during the first time slot (when the left lens film of the glasses 365A is on), and image 2.1 from channel three intended to be viewed by the right eye of the first player during the third time slot (when the right lens film of the glasses 365A is on) if the first player glances over from the adjacent wagering game machine 360A. In some examples, the additional 3D content can be a background image associated with the theme of the 3D wagering game being presented, a repeat of the main 3D game content being presented at the adjacent wagering game machine, 3D promotional material, game previews, or other 3D content. In one example, when the additional 3D content is a background image associated with the theme of the 3D wagering game being presented, the additional 3D content can have the appearance of extending the player's display to the adjacent wagering game machines. For example, if the 3D wagering game is a bonus game with an airplane/sky theme, the additional 3D content can be a background image of the sky that is being presented in the player's display, and therefore can seem as if the sky background extends to the adjacent displays.

In some implementations, the bank game controller 375 determines the number of distinct channels of images that should be presented in the bank overhead display 370 based, at least in part, on whether the same 3D wagering game content should be presented in the bank overhead display 370 to all the players in the system 301, or whether different 3D wagering game content should be presented on the bank overhead display 370 to each player. In some examples, this determination can be made based on the type of content associated with the 3D wagering game and/or the type of presentation associated with the 3D wagering game. If the same 3D wagering game content should be presented in the bank overhead display 370 for all the players in the system 301, then the bank game controller 375 can transmit two distinct channels of images (i.e., one for each eye of the players) to the bank overhead display 370 for presentation. For example, as shown in the timing diagraph 410 of FIG. 4, the bank game controller 375 can cause the bank overhead display 370 to present image 3 from channel one (intended for the players' left eye) during both the first and second time slots, and image 3 from channel two (intended for the players' right eye) during both the third and fourth time slots, so that both the first and second players will view the same 3D wagering game content on the bank overhead display 370. For example, a video poker or blackjack game can be configured to present a virtual dealer (dealing cards, handing out chips, etc.) on the bank overhead display 370 that is intended to be viewed by all the players in the system 301. In this example, after the virtual dealer deals out the cards or hands out the chips, each player's wagering game machine 360 would then separately display each player's cards and chips. In some examples, if the bank game controller 375 determines that different 3D wagering game content should be presented in the bank overhead display 370 for the first player and the second player in system 301, then the bank game controller 375 can transmit four distinct channels of images (i.e., two channels for each player) to the bank overhead display 370 for presentation. For example, the bank game controller 375 can cause the bank overhead display 370 to present image 3 from channel one and three (intended for the first player's left and right eyes, respectively) during the first and third time slots, respectively (when the first player's glasses 365A are on), and a different image 4 from channel two and four (intended for the second player's left and right eyes, respectively) during the second and fourth time slots, respectively (when the second player's glasses 365B are on), so that the first and second players will view different 3D wagering game content on the bank overhead display 370. For example, a community bonus game (e.g., a community bonus picking game) can be presented on the bank overhead display 370 that presents each player different bonus picking options during the bonus round. In some implementations, the system 301 shown in FIG. 3 may also be configured to implement the complementary image cancellation technique in the wagering game machines 360 and the bank overhead display 370, similarly as was described above with reference to FIGS. 1-2B At stage C, the bank game controller 375 begins transmitting a synchronization signal to the wagering game machines 360 of the system 301 to synchronize the turning on/off of the left/right lens films of the active shutter 3D glasses 365 with the presentation of the 3D wagering game content in the wagering game machines 360 and in the bank overhead display 370. At each wagering game machine 360, the timing of the synchronization signal can synchronize the presentation of the corresponding images associated with the 3D wagering game content during the different time slots. For example, in the wagering game machine 360A, the timing of the synchronization signal can synchronize the sequential presentation of the four distinct channels of images during the four sequential time slots, as shown in the timing diagram 410 of FIG. 4. Furthermore, the synchronization signal can be provided from each wagering game machine 360 to the corresponding pair of active shutter 3D glasses to synchronize the turning on/off of the left/right lens films with the presentation of the 3D wagering game content during the different time slots. For example, as shown in the timing diagram 410 of FIG. 4, the synchronization signal can synchronize the turning on of the left lens film of the glasses 365A with the first time slot, synchronize the turning on of the right lens film of the glasses 365A with the second time slot, synchronize the turning on of the left lens film of the glasses 365B with the third time slot, and synchronize the turning on of the right lens film of the glasses 365B with the fourth time slot. At the same time, the bank game controller 375 can utilize the timing of the synchronization signal to synchronize the presentation of the 3D wagering game content intended to be presented on the bank overhead display 370 with the different time slots (e.g., as shown in FIG. 4 during the four time slots). This will synchronize the presentations in the wagering game machines 360, with the presentations in the bank overhead display 370, and also with the turning on/off of the active shutter 3D glasses 365.

At stage D, each wagering game machine 360 begins to concurrently and continuously present the distinct channels of images associated with the 3D wagering game content in at least one of the display (e.g., the main display 361) of the wagering game machines 360 according to the timing of the synchronization signal. Also, concurrently with the wagering game machines 360, the bank game controller 375 begins to continuously present on the bank overhead display 370 the distinct channels of images associated with the 3D wagering game content intended to be displayed in the bank overhead display 370 according to the timing of the synchronization signal.

At stage E1, the active shutter 3D glasses 365A turn on/off the left/right lens films based on the timing of the synchronization signal to allow the first player to view the 3D wagering game content intended for the first player on the display 361A of the wagering game machine 360A. Concurrently, at stage E2, the active shutter 3D glasses 365B turn on/off the left/right lens films based on the timing of the synchronization signal to allow the second player to view the 3D wagering game content intended for the second player on the display 361B of the wagering game machine 360B. The process of presenting the distinct channel of images in the wagering game machines 360 and in the bank overhead display 370, and the corresponding process of turning on/off the left/right lens films of the active shutter 3D glasses 365 are repeated sequentially to display all of the 3D wagering game content (3D video).

It is noted, however, that in other embodiments the system 301 shown in FIG. 3 can be extended to more than two wagering game machines. For example, as shown in FIG. 5, the system 301 may comprises a bank of four wagering game machines 360A-360D, four active shutter 3D glasses 365A-365D, the bank overhead display 370, and the bank game controller 375. In this embodiment, since the number of machines 360, glasses 365, and players have doubled (from two players to four players), the number of time slots that will be used to synchronize the presentation of different 3D wagering game content to the four players also doubles from four time slots to eight time slots.

In some implementations, as shown in the example timing diagram 610 of FIG. 6, the bank game controller 375 and/or one of the wagering game machines 360 can designate one of the players as the primary player, and all the other players as secondary players. This designation can be made in a situation where one player has entered a bonus round, and is shown 3D bonus content none of the other players should see. In this implementation, as shown in FIG. 6, the wagering game machine 360 for the primary player drives its own 3D bonus content during the time slot designated Image X (i.e., the first and third time slots), while the secondary players all drive their own 3D wagering game content during the Image X.1 time slot (i.e., the second and fourth time slots). For example, assuming that wagering game machine 360B is the machine that is currently occupied by the primary player (in the bonus round), Image 2 would be the local content of the wagering game machine 360B, while Image 2.1 is the content intended to be seen by the other players if they look at the display 361B of machine 360B. Wagering game machine 360A (and 360C and 360D) would display their own 3D wagering game content (intended for the secondary players) during the Image 1.1 time slot (and Image 3.1 and Image 4.1 time slots, respectively), and display the content intended to be seen by the primary player during the Image 1 time slot (and Image 3 and Image 4 time slots, respectively). Furthermore, in some implementations, the display 370 can display different 3D content for the primary player than for the secondary players. For example, in the timing diagram 610 of FIG. 6, the primary player is presented the Image 5 content during the first and third time slots (i.e., when the primary player's glasses are on), and the secondary players are presented the Image 6 content during the second and fourth time slots (i.e., when the secondary players' glasses are on).

In one implementation, the synchronization signal can be generated based on one or more timers (or other similar mechanisms) that are implemented at the bank game controller 175 that are used for synchronizing the presentation of the distinct channels of images during the different time slots. For example, the one or more timers can be used by the hardware/software in the video card included in the bank game controller 175 for presenting the 3D game content on the bank overhead display 170. Furthermore, in addition to synchronizing the operation of the active shutter 3D glasses, when the synchronization signal is received at the wagering game machines 360 shown in FIGS. 3 and 5, the synchronization signal also synchronizes the video cards (and other associated hardware/software) in order to synchronize the different presentations of 3D wagering game content in the different wagering game machines 360 of the system 301. One example block diagram of the bank game controller 175 is shown in FIG. 7 (and described below). In one implementation, the one or more timers that are used to generate the synchronization signal can be implemented by the bank synchronization unit 776 of the bank game controller 175.

Although FIGS. 1-6 describe examples of coordinating the presentation of 3D wagering game content in a bank of wagering game machines (including a bank overhead display), it is noted that in other implementations the techniques described herein can be implemented in other types of wagering game machines. For example, the bank of wagering game machines can include two or more bank overhead displays, and/or other types of common displays (e.g., common wrap around displays, common side displays, common tower displays, etc.). Furthermore, in other implementations, the techniques described herein can be implemented in a multiplayer electronic table gaming machine comprising a plurality of active shutter 3D glasses, one or more common overhead displays, and a common tabletop display. In some implementations, instead of having a separate bank game controller in the bank of wagering game machines (e.g., bank game controller 375 of FIG. 3), one of the wagering game machines in the bank can function as the bank game controller (or master wagering game machine) of the bank. In another example, the functionality of the bank game controller can be distributed across some or all of the wagering game machines of the bank. Additionally, it is noted that although the example timing diagrams of FIGS. 2A, 2B, 4, and 6 illustrate a specific order of presenting the different channels of images, in other examples, the channels of images can be presented in a different order. For example, in the timing diagram 210 of FIG. 2A, the image one for the right eye can be presented in the second time slot and the image two for the left eye can be presented in the third time slot (and the rest of the timing diagram can be adjusted accordingly).

Although FIGS. 1-6 describe some embodiments, the following sections describe many other features and embodiments.

Operating Environment

This section describes example operating environments and networks and presents structural aspects of some embodiments. More specifically, this section includes discussion about wagering game system architectures.

Wagering Game System Architectures

FIG. 7 is a conceptual diagram that illustrates an example of a wagering game system architecture 700, according to some embodiments. As illustrated, the wagering game system architecture 700 includes a wagering game controller 710 and a plurality of wagering game machines 760. The wagering game controller 710 is configured to control game content (e.g., game elements, game updates, game results, secondary game content, etc.) and communicate game-related information (e.g., player account information, game chat, virtual gaming community services, casino services, and other server-based content) to and from the plurality of wagering game machines 760. As shown in FIG. 7, in one example, the wagering game controller 710 includes a wagering game server 750, an account server 770, and a community server 780. The wagering game controller 710 may also be configured to communicate with other systems, devices, and networks (e.g., other physical casino networks and/or online casino systems). As shown in FIG. 7, the plurality of wagering game machines 760 of the wagering game system 700 can include one or more individual wagering game machines 760, one or more electronic table gaming machines 760, and one or more banks 701 of wagering game machines 760. Some of the wagering game machines 760 can be configured to present wagering game content in 3D. As shown in FIG. 7, in some examples, a bank 701 of wagering game machines 760 that is configured to present wagering game content in 3D can include two wagering game machines 760A-760B (e.g., similar to FIG. 1 and FIG. 3) and a bank game controller 775. It is noted, however, that in other examples the bank 701 can include more than two wagering game machines (e.g. similar to FIG. 5).

The wagering game server 750 is configured to manage and control content for games presented on the wagering game machines 760. In some embodiments, the wagering game server 750 includes a game management unit 752 configured to manage game content and provide (e.g., stream) game content (e.g., secondary game content, game updates, etc.) and other game-related information to the wagering game machines 760. The game management unit 752 can be configured to generate (e.g., using a random numbers generator) game results (e.g., win/loss values), including win amounts, for wagering games played on the wagering game machines 760. The game management unit 752 can communicate the game results to the wagering game machines 760 via the network 755. In some embodiments, the game management unit 752 can generate random numbers and provide them to the wagering game machines 760 so that the wagering game machines 760 can generate game results. It is noted, however, that in some embodiments the wagering game machines 760 can locally generate random numbers to determine game results. The wagering game server 750 can also include a content store 754 configured to store game content (e.g., base games content, backups, updates, secondary bonus game content, etc.) and other game-related information associated with games presented on the wagering game machines 760.

The account server 770 is configured to manage player-related accounts associated with the wagering game system 700. The account server 770 can manage player financial accounts (e.g., performing funds transfers, deposits, withdrawals, etc.) and player information (e.g., account identification numbers, player activity information, financial information, screen name, social contacts, etc.). The account server 770 can also provide auditing capabilities, according to regulatory rules, and track the performance of players, machines, and servers. The account server 770 can include an account controller configured to manage information for player wagering game system accounts. The account server 770 can also include an account store configured to store information for player wagering game system accounts (e.g., player account information, player activity information, etc).

The community server 780 is configured to provide a wide range of services to members of virtual gaming communities. For example, the community server 780 may allow players to:

- Create Social Networks—When creating social networks, members can create electronic associations that inform network members when selected members are: 1) online, 2) performing activities, 3) reaching milestones, 4) etc.
- Establish a Reputation—Community members can establish reputations based on feedback from other community members, based on accomplishments in the community, based on who is in their social network, etc.
- Provide Content—Community members can provide content by uploading media, designing wagering games, maintaining blogs, etc.
- Filter Content—Community members can filter content by rating content, commenting on content, or otherwise distinguishing content.
- Interact with Other Members—Community members can interact via newsgroups, chat, e-mail, discussion boards, instant messaging, etc.
- Participate in Community Activities—Community members can participate in community activities, such as multi-player games, interactive meetings, discussion groups, real-life meetings, etc.
- Connect Casino Players to Online Members—Community members who are playing in casinos can interact with members who are online. For example, online members may be able to: see activities of social contacts in the casino, chat with casino players, participate in community games involving casino players, etc.

In some embodiments, the community server 780 enables online community members (e.g., operating a personal computer (PC) or a mobile device) to participate in and/or monitor wagering games that are being presented in one or more casinos. The community server 780 can enable community members to connect with and track each other. For example, the community server 780 can enable community members to select other members to be part of a social network. The community server 780 can also enable members of a social network to track what other social network members are doing in a virtual gaming community and a real-world casino. For example, in some implementations, the community server 780 assists in enabling members of a social network to see when network members are playing wagering game tables and machines in a casino, accessing a virtual gaming community web site, achieving milestones (e.g., winning large wagers in a casino), etc.

The community server 780 can store and manage content for a virtual gaming community. For example, in some embodiments, the community server 780 can host a web site for a virtual gaming community. Additionally, the community server 780 can enable community members and administrators to add, delete, and/or modify content for virtual gaming communities. For example, the community server 780 can enable community members to post media files, member-designed games, commentaries, etc., all for consumption by members of a virtual gaming community.

The community server 780 can track behavior and gaming activity of community members. In some embodiments, the community server 780 tracks how individuals and/or groups use the services and content available in a virtual gaming community. The community server 780 can then report the gaming activity of each player to the wagering game server 750 and/or the account server 770. The community server 780 can analyze member behavior and categorize community members based on their behavior. The community server 780 can configure network components to customize content based on individual habits and/or group habits.

The wagering game machines 760 of the bank 701 (e.g., machines 760A-760B) are configured to present wagering games and receive and transmit information (e.g., game updates to/from the wagering game server 750) to control the content that is presented for the wagering games. Each wagering game machine 760 of the bank 701 can include a 3D glasses control unit 762, a game management unit 764, a content store 766, and a presentation unit 768. The content store 766 is configured to store 3D content that is presented on the wagering game machine 760.

The presentation unit 768 is configured to control the presentation of the 3D game content (and other game-related content) on the wagering game machine 760. The presentation unit 768 can include one or more browsers and any other software and/or hardware (e.g., a video card) suitable for presenting audio and 3D video content. It is noted, however, that in other implementations the game content can be presented using other display technologies.

The game management unit 764 is configured to manage and control the 3D game content and the game events associated with the wagering games (and other game-related content) that are presented on the wagering game machine 760. The game management unit 764 can work in conjunction with the presentation unit 768 to synchronize the presentation of the 3D wagering game content in at least one display of the wagering game machine 760 with the 3D wagering game content presented in the rest of the bank 701 (i.e., the other machines and the bank overhead display) according to the synchronization signal received from the bank game controller 775, as described herein with reference to FIGS. 3-6 and 9. Furthermore, the game management unit 764 can generate game results based on random numbers received from the wagering game server 750, or may communicate with the wagering game server 750 to obtain the game results. The 3D glasses control unit 762 is configure to send control signals from the wagering game machine 760 to the corresponding pair of active shutter 3D glasses coupled to the wagering game machine 760. For example, the 3D glasses control unit 762 can send the synchronization signal received from the bank game controller 775 to the active shutter 3D glasses to synchronize the turning on/off of the left/right lens films with the presentation of the corresponding 3D wagering game content, as described herein with reference to FIGS. 1-6 and 8-9. In one implementation, the active shutter 3D glasses 765 are tethered via a wire to the corresponding wagering game machine 760. In other implementations, the active shutter 3D glasses 765 wirelessly connect to the corresponding wagering game machine 760 (e.g., via infrared, RF frequencies, or other wireless technologies).

In some implementations, the bank game controller 775 comprises a bank synchronization unit 776 and a common display management unit 778. In some banks 701 of wagering game machines 760 that are configured to present 3D wagering game content for multiple players only on the bank overhead display (e.g., the system 101 of FIG. 1), the bank synchronization unit 776 is configured to determine the number of active wagering game machines 760 in the bank 701. The bank synchronization unit 776 is then configured to determine the number of distinct channels of images associated with the 3D wagering game content to present sequentially in the bank overhead display during a corresponding number of sequential time slots based, at least in part, on the number of active wagering game machines 760, as was described herein with reference to FIGS. 1-2B and 8. In some banks 701 of wagering game machines 760 that are configured to present different 3D wagering game content for multiple players in at least one display of each wagering game machines 760 of the bank 701 and also in the bank overhead display (e.g., the system 301 of FIGS. 3 and 5), the bank synchronization unit 776 is configured to determine the number of distinct channels of images associated with the 3D wagering game content to present sequentially in each wagering game machine 760, and also the 3D wagering game content to sequentially present in the bank overhead display, during a corresponding number of sequential time slots, as was described herein with reference to FIGS. 3-6 and 9. The bank synchronization unit 776 is also configured to generate the synchronization signal that is used to synchronize the turning on/off of the left/right lens films of the active shutter 3D glasses with the presentation of the 3D wagering game content, and send the synchronization signal to each of the wagering game machines 760 and to the common display management unit 778. In one implementation, the bank synchronization unit 776 comprises one or more timers that are used to generate the synchronization signal (e.g., based on the number of time slots associated with the presentation of the 3D wagering game content). The common display management unit 778 is configured to present the 3D wagering game content in the bank overhead display according to the timing of the synchronization signal. In one implementation, the common display management unit 778 may include similar functionality as the game management unit 764, the content store 766, and the presentation unit 768 for storing, managing, and presenting the 3D wagering game content.

The wagering game machines described herein (e.g., wagering game machines 760) can take any suitable form, such as floor standing models, handheld mobile units, bar-top models, workstation-type console models, surface computing machines, etc., and can access a communication network 755 to communication with the wagering game controller 710 via a wireless or wired connection. Further, wagering game machines can be primarily dedicated for use in conducting wagering games, or can include non-dedicated devices, such as personal computers (PC), mobile phones, personal digital assistants (PDAs), laptop computers, etc. For example, the non-dedicated devices can provide players access to wagering games via a wireless network within a physical casino, or remotely via the Internet.

In some embodiments, each of the wagering game machines 760 and the wagering game server 750 are configured to work together such that the wagering game machine 760 can be operated as a thin, thick, or intermediate client. For example, one or more elements of game play may be controlled by the wagering game machine 760 (client) or the wagering game server 750 (server). Game play elements can include executable game code, lookup tables, configuration files, game results, audio or visual representations of the game, game assets or the like. In a thin-client example, the wagering game server 750 can perform functions such as determining game results or managing assets, while the wagering game machine 760 can present an audible/graphical representation of such outcome or asset modification to the players. In a thick-client example, the wagering game machine 760 can determine game outcomes and communicate the outcomes to the wagering game server 750 for recording or managing a player's wagering game system account.

In some embodiments, either the wagering game machines (client) or the wagering game server(s) can provide functionality that is not directly related to game play. For example, account transactions and account rules may be managed centrally (e.g., by the wagering game server(s)) or locally (e.g., by the wagering game machines). Other functionality not directly related to game play may include power management, software or firmware updates, system quality or security checks, etc.

Each component shown in the wagering game system architecture 700 is shown as a separate and distinct element connected via the communications network 755. However, some functions performed by one component could be performed by other components. For example, the wagering game server 750 can be configured to perform some or all of the functions of the account server 770. Furthermore, the components shown may all be contained in one device, but some, or all, may be included in, or performed by multiple devices, as in the configurations shown in FIG. 7 or other configurations not shown, e.g., the bank game controller 775 can be implemented within one of the wagering game machines 760 in the bank 701, or functionality associated with the bank game controller 775 can be distributed across all the wagering game machines 760 of the bank 701. Furthermore, the wagering game system architecture 700 can be implemented as software, hardware, any combination thereof, or other forms of embodiments not listed. For example, any of the network components (e.g., the wagering game machines, servers, etc.) can include hardware and machine-readable media including instructions (e.g., executable by one or more processors) for performing the operations described herein. Machine-readable media includes any mechanism that provides (i.e., stores and/or transmits) information in a form readable by a machine (e.g., a wagering game table, machine, computer, etc.). For example, tangible machine-readable storage media includes read only memory (ROM), random access memory (RAM), magnetic disk storage media, optical storage media, flash memory machines, and other types of tangible medium suitable for storing instructions. Machine-readable transmission media includes any media suitable for transmitting software over a network.

Example Operations

This section describes operations associated with some embodiments. In the discussion below, the flow diagrams will be described with reference to the block diagrams presented above. However, in some embodiments, the operations can be performed by logic not described in the block diagrams.

In certain embodiments, the operations can be performed by executing instructions residing on machine-readable storage media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform less than all the operations shown in any flow diagram.

Figure 8:
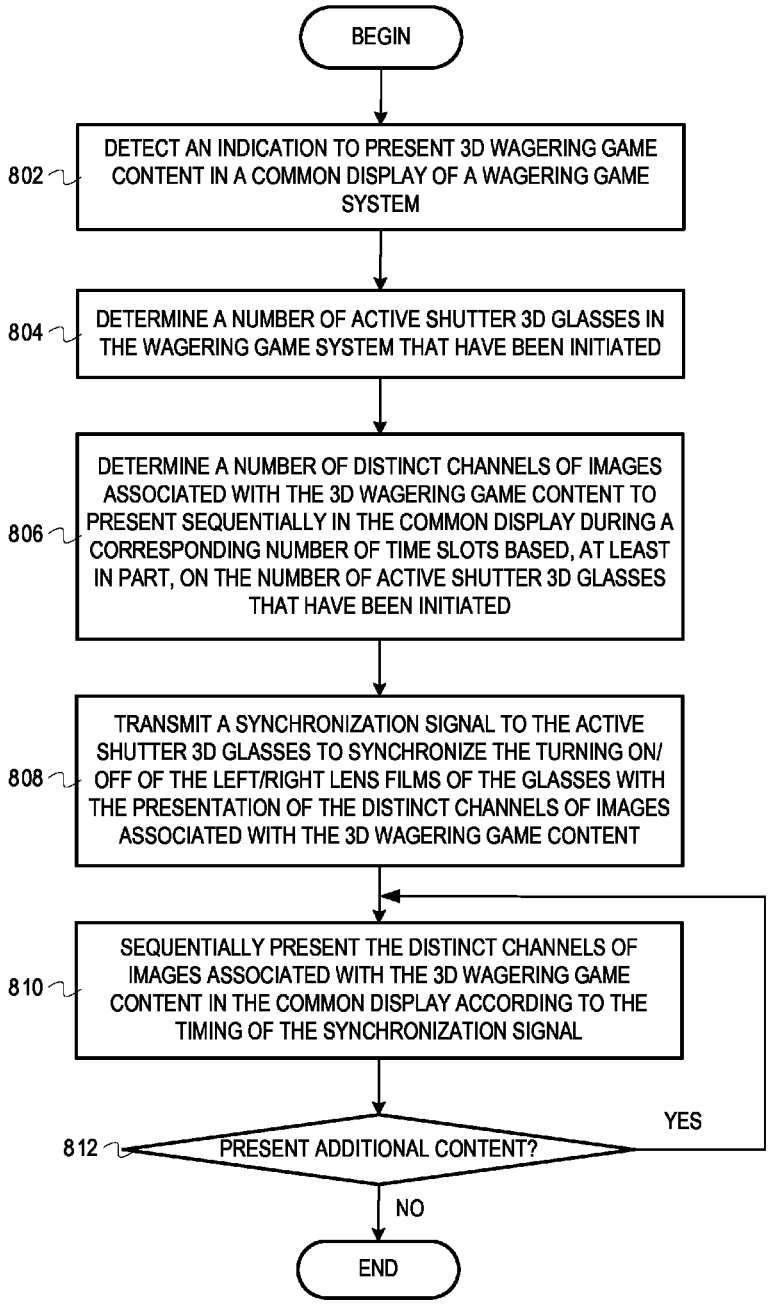
FIG. 8 is a flow diagram illustrating operations for coordinating the presentation of 3D wagering game content in a common display for multiple players, according to some embodiments.
Figure 9:
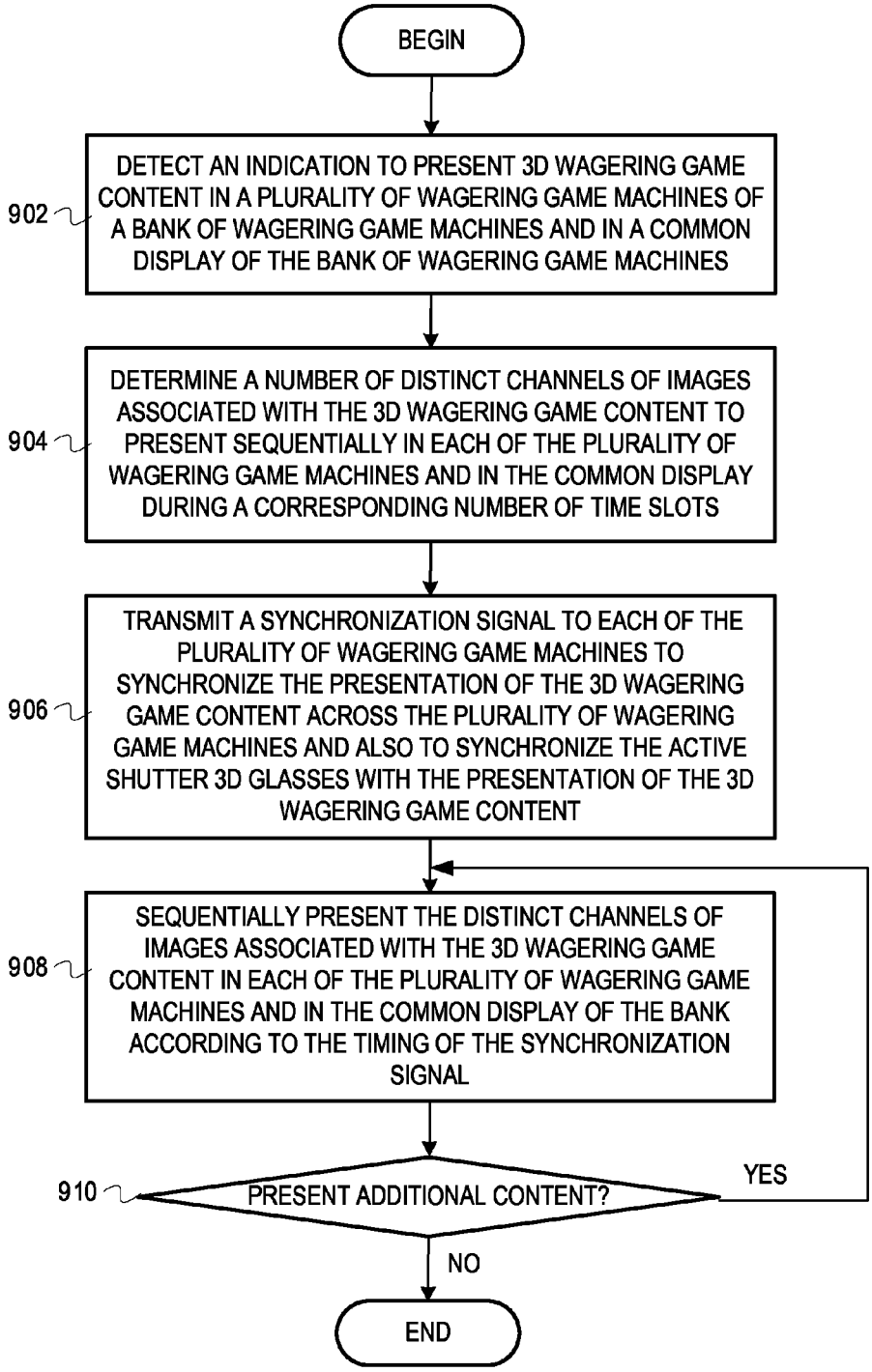
FIG. 9 is a flow diagram illustrating operations for coordinating the presentation of 3D wagering game content in a plurality of wagering game machines and in a common display for multiple players, according to some embodiments.

The following discussion of FIGS. 8-9 describes example operations for coordinating the presentation of 3D wagering game content in a wagering game system comprising active shutter 3D glasses.

FIG. 8 is a flow diagram ("flow") 800 illustrating operations for coordinating the presentation of 3D wagering game content in a common display for multiple players, according to some embodiments. The flow 800 will be described with reference to the example system 101 of FIGS. 1-2B and the example system architecture of FIG. 7. The flow diagram begins at block 802.

At block 802, the bank synchronization unit 776 of the bank game controller 775 detects an indication to present 3D wagering game content in a common display of a wagering game system 701, similarly as was described above with reference to FIG. 1. In one example, the wagering game system 701 is a bank of wagering game machines 760 with a common overhead display and a plurality of active shutter 3D glasses. In another example, the wagering game system 701 is an electronic table gaming machine with a common overhead display (and a common tabletop display) and a plurality of active shutter 3D glasses. After block 802, the flow continues at block 804.

At block 804, the bank synchronization unit 776 determines the number of active shutter 3D glasses of the wagering game system 701 that have been initiated (i.e., ready to be used for viewing 3D wagering game content). In one example, the active shutter 3D glasses are initiated in response to said detecting an indication to present 3D wagering game content (e.g., after the players log in to the wagering game system 701 or after a 3D bonus game is triggered). After block 804, the flow continues at block 806.

At block 806, the bank synchronization unit 776 determines a number of distinct channels of images associated with the 3D wagering game content to present sequentially in the common display during a corresponding number of time slots base, at least in part, on the number of active shutter 3D glasses of the wagering game system 701 that have been initiated, similarly as was described above with reference to FIGS. 1 and 2A. For example, in the system 101 of FIG. 1, if the two pairs of active shutter 3D glasses have been initiated, then four distinct channels of images are presented sequentially in the common display during four time slots. In another example, when complementary image cancellation (e.g., see FIG. 2B), then eight distinct channels of images are presented sequentially in the common display during eight time slots. After block 806, the flow continues at block 808.

At block 808, the bank synchronization unit 776 transmits a synchronization signal to the active shutter 3D glasses of the system 701 to synchronize the turning on/off of the left/right lens films of the glasses with the presentation of the distinct channels of images associated with the 3D wagering game content, similarly as was described above with reference to FIGS. 1 and 2A. After block 808, the flow continues at block 810.

At block 810, the common display management unit 778 of the bank game controller 775 sequentially presents the distinct channels of images associated with the 3D wagering game content in the common display according to the timing of the synchronization signal, similarly as was described above with reference to FIGS. 1 and 2A. After block 810, the flow continues at block 812.

At block 812, it is determined whether to continue presenting additional 3D wagering game content. If it is determined to continue presenting additional 3D wagering game content, the flow loops back to block 810. If it is determined to stop presenting additional 3D wagering game content, the flow ends.

FIG. 9 is a flow diagram 900 illustrating operations for coordinating the presentation of 3D wagering game content in a plurality of wagering game machines and in a common display for multiple players, according to some embodiments. The flow 900 will be described with reference to the example system 301 of FIGS. 3-4 and the example system architecture of FIG. 7. The flow diagram begins at block 902.

At block 902, the game management unit 764 of each wagering game machine 760 and the bank synchronization unit 776 of the bank game controller 775 detect an indication to present 3D wagering game content in a plurality of wagering game machines 760 of a bank of wagering game machines and in a common display of the bank of wagering game machines, similarly as was described above with reference to FIG. 3. In one example, the bank comprises two wagering game machines 760 with two pairs of active shutter 3D glasses and a common overhead display (as shown in FIG. 3). In another example, the bank comprises four wagering game machines 760 with four pairs of active shutter 3D glasses and a common overhead display (as shown in FIG. 5). After block 902, the flow continues at block 904.

At block 904, the game management unit 764 of each wagering game machine 760 and the bank synchronization unit 776 determine a number of distinct channels of images associated with the 3D wagering game content to present sequentially in each of the plurality of wagering game machines 760 and in the common display during a corresponding number of time slots, similarly as was described above with reference to FIGS. 3-4. In some implementations, each wagering game machine 760 of the bank can present two distinct channels of related images (i.e., one for each eye of the player) associated with the 3D wagering game content intended to be viewed by the player, and two additional distinct channels of images associated with 3D wagering game content intended to be viewed by players at adjacent wagering game machines (i.e., if the adjacent players attempt to glance over at the player's machine) for a total of four distinct channels of images during four sequential time slots (as shown in FIG. 4). At the same time, the common display of the bank can either display the same 3D wagering game content to all the players of the bank during the four time slots, or display different 3D wagering game content to the players of the bank during the four time slots, as was described above with reference to FIGS. 3-4. After block 904, the flow continues at block 906.

At block 906, the bank synchronization unit 776 transmits a synchronization signal to each of the plurality of wagering game machines 760 to synchronize the presentation of the 3D wagering game content across the plurality of wagering game machines 760 and also to synchronize the active shutter 3D glasses with the presentation of the 3D wagering game content, similarly as was described above with reference to FIGS. 3-4. After block 906, the flow continues at block 908.

At block 908, the game management unit 764 of each wagering game machine 760 sequentially presents the distinct channels of images associated with the individual 3D wagering game content in the corresponding wagering game machines 760, and the common display management unit 778 of the bank game controller 775 sequentially presents the distinct channels of images associated with the community 3D wagering game content in the common display of the bank, similarly as was described above with reference to FIGS. 3-4 (or, if one of the player is designated as the primary player, the 3D wagering game content is presented according to the description of FIG. 6). After block 908, the flow continues at block 910.

At block 910, it is determined whether to continue presenting additional 3D wagering game content. If it is determined to continue presenting additional 3D wagering game content, the flow loops back to block 908. If it is determined to stop presenting additional 3D wagering game content, the flow ends.

It should be understood that the depicted diagrams are examples meant to aid in understanding embodiments and should not be used to limit embodiments or limit scope of the claims. Embodiments may perform additional operations, fewer operations, operations in a different order, operations in parallel, and some operations differently. For example, in some implementations, the wagering game machines 760 can use machine vision (e.g., a camera with associated hardware/software) to detect when a player removes the active shutter 3D glasses. In response to detecting that the player removed the active shutter 3D glasses, the wagering game machine 760 can change the presentation of the wagering game content from 3D to 2D on at least one of the displays of the wagering game machine 760. In some implementations, instead of presenting the 3D wagering game content in at least one of the displays of each of the wagering game machines of a bank, the bank of wagering game machines can include 3D glasses with heads-up displays, and the 3D wagering game content can be presented in the heads-up display within the 3D glasses. In some implementations, each bank of wagering game machines can include active display barriers between each adjacent wagering game machine that can be used to both present additional content (e.g., a 180 degree wrap around display) and also block the view of each player's display from adjacent players.

Example Wagering Game Machines

This section describes example operating environments, systems and networks, and presents structural aspects of some embodiments.

Wagering Game Machine Architecture

Figure 10:
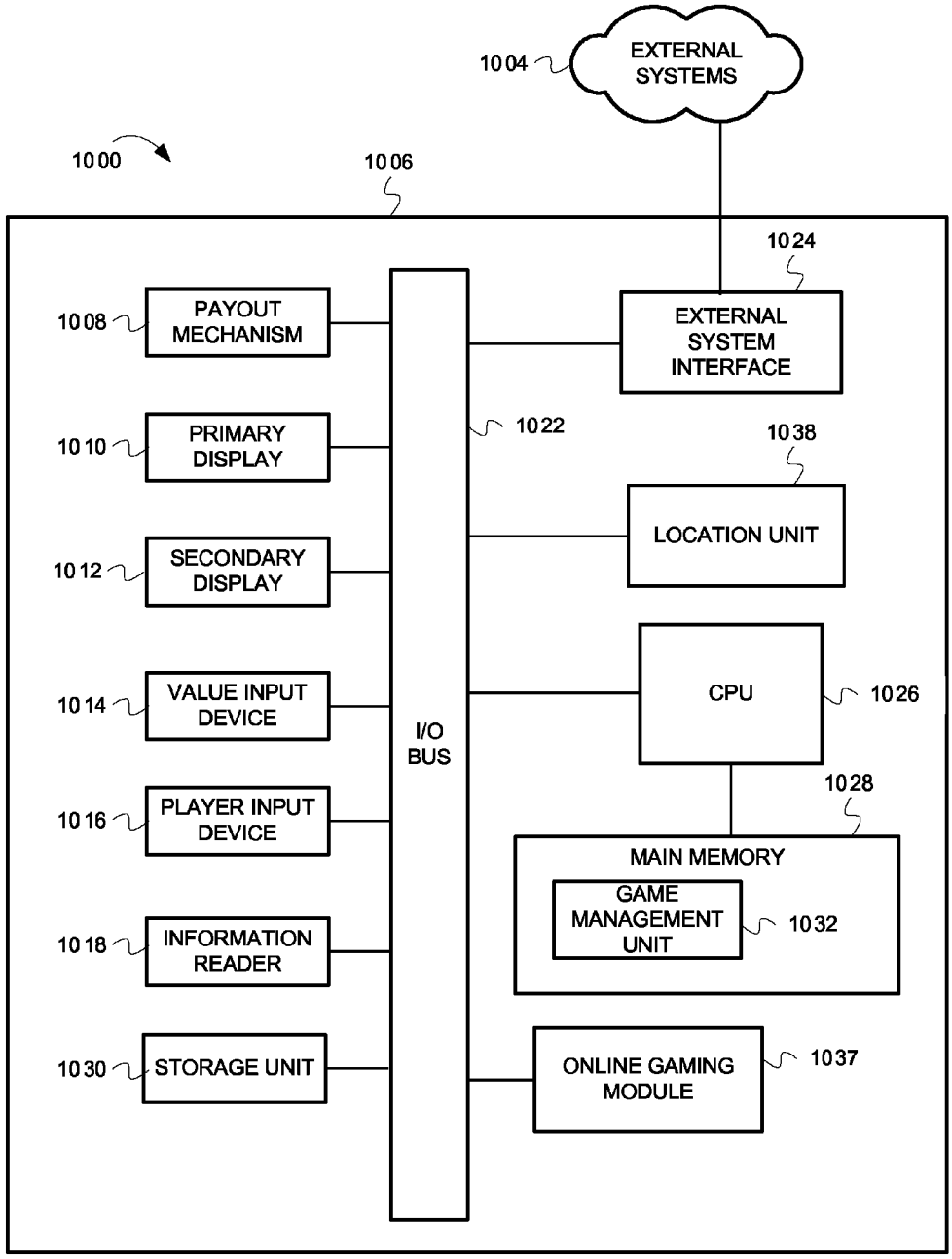
FIG. 10 is a conceptual diagram that illustrates an example of a wagering game machine architecture, according to some embodiments.

FIG. 10 is a conceptual diagram that illustrates an example of a wagering game machine architecture 1000, according to some embodiments. In FIG. 10, the wagering game machine architecture 1000 includes a wagering game machine 1006, which includes a central processing unit (CPU) 1026 connected to main memory 1028. The CPU 1026 can include any suitable processor, such as an Intel® Pentium processor, Intel® Core 2 Duo processor, AMD Opteron™ processor, or UltraSPARC processor. The main memory 1028 includes a game management unit 1032. In some embodiments, the game management unit 1032 can present 2D and 3D wagering games, such as video poker, video black jack, video slots, video lottery, reel slots, etc., in whole or part, e.g., as described above with reference to FIGS. 1-9.

The CPU 1026 is also connected to an input/output ("I/O") bus 1022, which can include any suitable bus technologies, such as an AGTL+frontside bus and a PCI backside bus. The I/O bus 1022 is connected to a payout mechanism 1008, primary display 1010, secondary display 1012, value input device 1014, player input device 1016, information reader 1018, and storage unit 1030. The player input device 1016 can include the value input device 1014 to the extent the player input device 1016 is used to place wagers. The I/O bus 1022 is also connected to an external system interface 1024, which is connected to external systems 1004 (e.g., wagering game networks). In some examples, the external system interface 1024 can include a 3D glasses control unit (e.g., 3D glasses control unit 762 shown in FIG. 7) used for sending control signals (e.g., the synchronization signal) to a pair of active shutter 3D glasses associated with the wagering game machine 1006. The external system interface 1024 can include logic for exchanging information over wired and wireless networks (e.g., 802.11g transceiver, Bluetooth® transceiver, Ethernet transceiver, etc.).

The I/O bus 1022 is also connected to a location unit 1038. The location unit 1038 can create player information that indicates the wagering game machine's location/movements in a casino. In some embodiments, the location unit 1038 includes a global positioning system (GPS) receiver that can determine the wagering game machine's location using GPS satellites. In other embodiments, the location unit 1038 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 10, in some embodiments, the location unit 1038 is not connected to the I/O bus 1022.

In some embodiments, the wagering game machine 1006 can include additional peripheral devices and/or more than one of each component shown in FIG. 10. For example, in some embodiments, the wagering game machine 1006 can include multiple external system interfaces 1024 and/or multiple CPUs 1026. In some embodiments, any of the components can be integrated or subdivided.

In some embodiments, the wagering game machine 1006 includes an online gaming module 1037. The online gaming module 1037 can process communications, commands, or other information, where the processing can control and present online wagering games. In some embodiments, the online gaming module 1037 can work in concert with the game management unit 1032, and can perform any of the operations described above.

Furthermore, any component of the wagering game machine 1006 can include hardware, firmware, and/or machine-readable media including instructions for performing the operations described herein.

Example Wagering Game Machines

Figure 11:
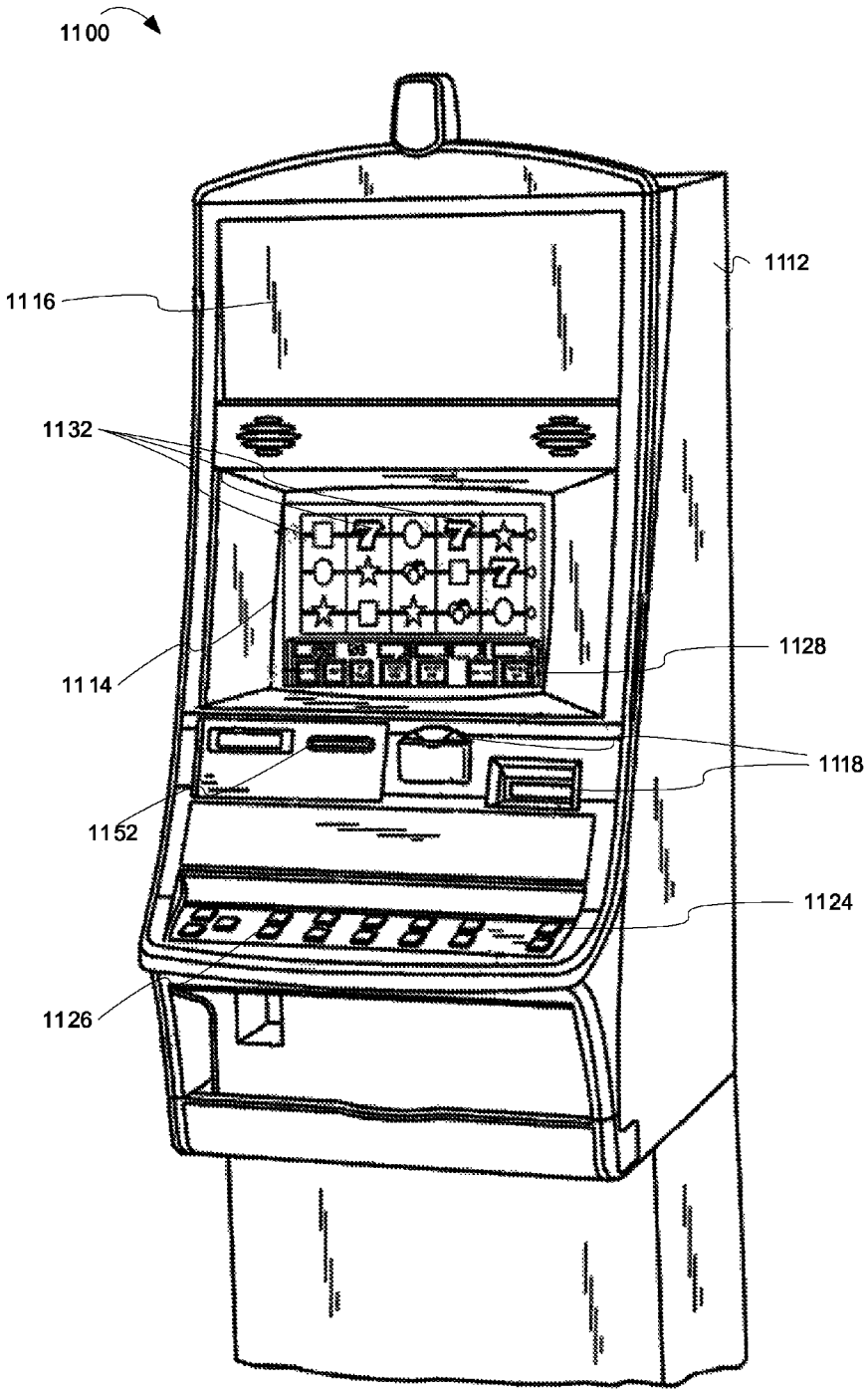
FIG. 11 is a perspective view of a wagering game machine, according to example embodiments.

FIG. 11 is a perspective view of a wagering game machine, according to example embodiments. Referring to FIG. 11, a wagering game machine 1100 is used in gaming establishments, such as casinos. In some embodiments, the wagering game machine 1100 can implement some of the functionality described above for coordinating the presentation of 3D wagering game content, e.g., as described above with reference to FIGS. 1-9.

According to embodiments, the wagering game machine 1100 can be any type of wagering game machine and can have varying structures and methods of operation. For example, the wagering game machine 1100 can be an electromechanical wagering game machine configured to play mechanical slots, or it can be an electronic wagering game machine configured to play video casino games, such as blackjack, slots, keno, poker, blackjack, roulette, etc.

The wagering game machine 1100 comprises a housing 1112 and includes input devices, including value input devices 1118 and a player input device 1124. For output, the wagering game machine 1100 includes a primary display 1114 for displaying information about a basic wagering game. In some implementations, the primary display 1114 can also display information about a bonus wagering game and a progressive wagering game. The wagering game machine 1100 also includes a secondary display 1116 for displaying bonus wagering games, wagering game events, wagering game outcomes, and/or signage information. While some components of the wagering game machine 1100 are described herein, numerous other elements can exist and can be used in any number or combination to create varying forms of the wagering game machine 1100.

The value input devices 1118 can take any suitable form and can be located on the front of the housing 1112. The value input devices 1118 can receive currency and/or credits inserted by a player. The value input devices 1118 can include coin acceptors for receiving coin currency and bill acceptors for receiving paper currency. Furthermore, the value input devices 1118 can include ticket readers or barcode scanners for reading information stored on vouchers, cards, or other tangible portable storage devices. The vouchers or cards can authorize access to central accounts, which can transfer money to the wagering game machine 1100.

The player input device 1124 comprises a plurality of push buttons on a button panel 1126 for operating the wagering game machine 1100. In addition, or alternatively, the player input device 1124 can comprise a touch screen 1128 mounted over the primary display 1114 and/or secondary display 1116.

The various components of the wagering game machine 1100 can be connected directly to, or contained within, the housing 1112. Alternatively, some of the wagering game machine's components can be located outside of the housing 1112, while being communicatively coupled with the wagering game machine 1100 using any suitable wired or wireless communication technology.

The operation of the basic wagering game can be displayed to the player on the primary display 1114. The primary display 1114 can also display a bonus game associated with the basic wagering game. The primary display 1114 can include a cathode ray tube (CRT), a high resolution liquid crystal display (LCD), a plasma display, light emitting diodes (LEDs), or any other type of display suitable for use in the wagering game machine 1100. Alternatively, the primary display 1114 can include a number of mechanical reels to display the outcome. In FIG. 11, the wagering game machine 1100 is an "upright" version in which the primary display 1114 is oriented vertically relative to the player. Alternatively, the wagering game machine can be a "slant-top" version in which the primary display 1114 is slanted at about a thirty-degree angle toward the player of the wagering game machine 1100.

In yet another embodiment, the wagering game machine 1100 can exhibit any suitable form factor, such as a free standing model, bartop model, mobile handheld model, an electronic table model, or workstation console model.

A player begins playing a basic wagering game by making a wager via the value input device 1118. The player can initiate play by using the player input device's buttons or touch screen 1128. The basic game can include arranging a plurality of symbols along a payline 1132, which indicates one or more outcomes of the basic game. Such outcomes can be randomly selected in response to player input. At least one of the outcomes, which can include any variation or combination of symbols, can trigger a bonus game.

In some embodiments, the wagering game machine 1100 can also include an information reader 1152, which can include a card reader, ticket reader, bar code scanner, RFID transceiver, or computer readable storage medium interface. In some embodiments, the information reader 1152 can be used to award complimentary services, restore game assets, track player habits, etc.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A computer-implemented method comprising:

detecting, at a system controller of a wagering game system, an indication to present three dimensional (3D) wagering game content in a common display of the wagering game system for a plurality of players;

determining, at the system controller, that a number of active shutter 3D glasses of the wagering game system have been initiated;

determining, at the system controller, a number of distinct image channels associated with the 3D wagering game content to present sequentially in the common display of the wagering game system during a corresponding number of sequential time slots based, at least in part, on the number of active shutter 3D glasses of the wagering game system that have been initiated;

transmitting a first synchronization signal to the active shutter 3D glasses to synchronize lens film activation operations with a presentation of the distinct image channels associated with the 3D wagering game content in the common display;

sequentially presenting the distinct image channels associated with the 3D wagering game content in the common display during the corresponding number of sequential time slots according to a timing of the first synchronization signal;

determining that the plurality of players should see common images associated with the 3D wagering game content in the common display;

transmitting a second synchronization signal to the active shutter 3D glasses, wherein the second synchronization signal causes the active shutter 3D glasses to synchronize lens film activation operations with one another and a presentation of distinct channels of the common images; and presenting the distinct channels of the common image in the common display.

2. The method of claim 1, wherein the wagering game system comprises one of a bank of wagering game machines including a plurality of active shutter 3D glasses and the common display, a single wagering game machine including the plurality of active shutter 3D glasses and the common display, and an electronic table gaming machine comprising the plurality of active shutter 3D glasses and the common display.

3. The method of claim 1, wherein said determining the number of distinct image channels associated with the 3D wagering game content to present sequentially in the common display of the wagering game system during the corresponding number of sequential time slots based, at least in part, on the number of active shutter 3D glasses of the wagering game system that have been initiated comprises:

determining the number of distinct image channels associated with the 3D wagering game content to present sequentially in the common display of the wagering game system during the corresponding number of sequential time slots based on the number of active shutter 3D glasses of the wagering game system that have been initiated and on whether the wagering game system is to implement complementary image cancellation for the 3D wagering game content.

4. The method of claim 3, further comprising:

in response to determining that a plurality of active shutter 3D glasses of the wagering game system have been initiated and determining that the wagering game system is not to implement complementary image cancellation for the 3D wagering game content, determining to sequentially present in the common display during the corresponding number of sequential time slots two distinct image channels associated with the 3D wagering game content for each pair of active shutter 3D glasses that has been initiated; and in response to determining that a plurality of active shutter 3D glasses of the wagering game system have been initiated and determining that the wagering game system is to implement complementary image cancellation for the 3D wagering game content, determining to sequentially present in the common display during the corresponding number of sequential time slots two distinct image channels associated with the 3D wagering game content for each pair of active shutter 3D glasses that has been initiated and two additional distinct complimentary image channels associated with the 3D wagering game content for each pair of active shutter 3D glasses that has been initiated.

5. The method of claim 4, wherein, in response to determining that two pairs of active shutter 3D glasses of the wagering game system have been initiated and determining that the wagering game system is to implement complementary image cancellation for the 3D wagering game content, determining to sequentially present in the common display four distinct image channels associated with the 3D wagering game content and four additional distinct complementary image channels associated with the 3D wagering game content during eight sequential time slots.

6. The method of claim 1, wherein said transmitting the first synchronization signal to the active shutter 3D glasses to synchronize lens film activation operations associated with the presentation of the distinct image channels associated with the 3D wagering game content in the common display comprises:

generating the first synchronization signal based, at least in part, on a timing of the corresponding number of sequential time slots; and transmitting the first synchronization signal to each pair of active shutter 3D glasses that has been initiated to synchronize a turning on and off of a left lens film and a right lens film of each pair of active shutter 3D glasses with the presentation of the distinct image channels associated with the 3D wagering game content in the common display during the corresponding number of sequential time slots.

7. The method of claim 1, wherein said determining that a number of active shutter 3D glasses of the wagering game system have been initiated comprises determining the number of active shutter 3D glasses of the wagering game system that have been initiated based on a number of players that are logged in at the wagering game system or based on a number of players that are scheduled to participate in a 3D wagering game associated with the 3D wagering game content.

8. The method of claim 1, further comprising:

detecting when one of the plurality of players removes a corresponding pair of active shutter 3D glasses during the presentation of the 3D wagering game content; and presenting two dimensional (2D) wagering game content in the common display of the wagering game system in response to said detecting when one of the plurality of players removes the corresponding pair of active shutter 3D glasses during the presentation of the 3D wagering game content.

9. A wagering game system comprising:

a plurality of related wagering game machines including a plurality of active shutter 3D glasses;

a common display; and a system controller coupled to the plurality of related wagering game machines and to the common display, and configured to detect an indication to present individual 3D wagering game content in each of the plurality of related wagering game machines and present community 3D wagering game content in the common display of the wagering game system, and further configured to:

determine a number of distinct channels of images associated with the community 3D wagering game content to present sequentially in the common display of the wagering game system during a corresponding number of time slots associated with the community 3D wagering game content;

transmit a first synchronization signal to each of the plurality of related wagering game machines to synchronize presentations of the individual 3D wagering game content across the plurality of related wagering game machines with lens film activation operations associated with the plurality of active shutter 3D glasses;

transmit a second synchronization signal to synchronize presentation of the community 3D wagering game content in the common display with lens film activation operations associated with the plurality of active shutter 3D glasses;

wherein each of the plurality of wagering game machines is configured to:

determine a number of distinct channels of images associated with the individual 3D wagering game content to present sequentially in the wagering game machine during a corresponding number of time slots associated with the individual 3D wagering game content;

sequentially present the distinct channels of images associated with the individual 3D wagering game content in the wagering game machine during the corresponding number of time slots associated with the individual 3D wagering game content according to a timing of the first synchronization signal received from the system controller; and wherein the system controller is configured to sequentially present the distinct channels of images associated with the community 3D wagering game content in the common display during the corresponding number of time slots associated with the community 3D wagering game content according to a timing of the second synchronization signal.

10. The wagering game system of claim 9, wherein the plurality of related wagering game machines comprise a bank of wagering game machines, and wherein each of the plurality of related wagering game machines comprises a corresponding one of the plurality of active shutter 3D glasses.

11. The wagering game system of claim 9, wherein each of the plurality of wagering game machines configured to determine the number of distinct channels of images associated with the individual 3D wagering game content to present sequentially in the wagering game machine during the corresponding number of time slots associated with the individual 3D wagering game content comprises each of the plurality of wagering game machines configured to:

determine the number of distinct channels of images associated with the individual 3D wagering game content to present sequentially in the wagering game machine during the corresponding number of time slots associated with the individual 3D wagering game content based on whether the wagering game system is to implement an image injection technique for the individual 3D wagering game content.

12. The wagering game system of claim 11, wherein, in response to determining that the wagering game system is not to implement the image injection technique for the individual 3D wagering game content, each of the plurality of wagering game machines is configured to determine to sequentially present two distinct channels of images associated with the individual 3D wagering game content in at least one display of the wagering game machine during two sequential time slots.

13. The wagering game system of claim 11, wherein, in response to determining that the wagering game system is to implement the image injection technique for the individual 3D wagering game content, each of the plurality of wagering game machines is configured to determine to sequentially present in at least one display of the wagering game machine during the corresponding number of sequential time slots two distinct channels of images associated with the individual 3D wagering game content and two additional distinct channels of images to implement the image injection technique.

14. The wagering game system of claim 9, wherein the system controller configured to determine the number of distinct channels of images associated with the community 3D wagering game content to present sequentially in the common display of the wagering game system during the corresponding number of time slots associated with the community 3D wagering game content comprises the system controller configured to:

determine the number of distinct channels of images associated with the community 3D wagering game content to present sequentially in the common display of the wagering game system during the corresponding number of time slots associated with the community 3D wagering game content based, at least in part, on whether the wagering game system is to implement an image injection technique for the individual 3D wagering game content.

15. The wagering game system of claim 9, wherein the system controller configured to transmit the synchronization signal to each of the plurality of related wagering game machines to synchronize presentations of the individual 3D wagering game content across the plurality of related wagering game machines with lens film activation operations associated with the plurality of active shutter 3D glasses comprises the system controller configured to:

generate the synchronization signal based, at least in part, on a timing of the corresponding number of time slots associated with the individual 3D wagering game content; and transmit the synchronization signal to each of the plurality of active shutter 3D glasses to synchronize a turning on and off of a left lens film and a right lens film of each pair of active shutter 3D glasses with the presentation of the distinct channels of images associated with the individual 3D wagering game content across the plurality of related wagering game machines and the presentation of the distinct channels of images associated with the community 3D wagering game content in the common display.

16. The wagering game system of claim 9, further comprising active display barriers located between each adjacent wagering game machine of the wagering game system, wherein the system controller is further configured to present additional wagering game content in the active display barriers of the wagering game system.

17. The wagering game system of claim 9, wherein each of the plurality of related wagering game machines comprises a camera configured to detect when a player removes a corresponding pair of active shutter 3D glasses during the presentation of the individual and community 3D wagering game content, and wherein the wagering game system is configured to present 2D wagering game content in each of the wagering game machines and in the common display in response to a wagering game machine detecting when the player removes the corresponding pair of active shutter 3D glasses during the presentation of the individual and community 3D wagering game content.

18. One or more non-transitory machine-readable storage media, having instructions stored therein, which, when executed by one or more processors causes the one or more processors to perform operations that comprise:

detecting an indication to present 3D wagering game content in a common display of a wagering game system for a plurality of players;

determining a number of active shutter 3D glasses of the wagering game system that have been initiated;

determining a number of distinct channels of images associated with the 3D wagering game content to present sequentially in the common display of the wagering game system during a corresponding number of sequential time slots based, at least in part, on the number of active shutter 3D glasses of the wagering game system that have been initiated;

transmitting a synchronization signal to the active shutter 3D glasses to synchronize lens film activation operations associated with the active shutter 3D glasses with a presentation of the distinct channels of images associated with the 3D wagering game content in the common display;

sequentially presenting the distinct channels of images associated with the 3D wagering game content in the common display during the corresponding number of sequential time slots according to a timing of the synchronization signal;

determining that the plurality of players should see common images associate with the 3D wagering game content in the common display;

transmitting a second synchronization signal to the active shutter 3D glasses, wherein the second synchronization signal causes the active shutter 3D glasses to synchronize lens film activation operations associated with the active shutter 3D glasses with one another and a presentation of distinct channels of the common images; and presenting the distinct channels of the common image in the common display.

19. The non-transitory machine-readable storage media of claim 18, wherein said operation of determining the number of distinct channels of images associated with the 3D wagering game content to present sequentially in the common display of the wagering game system during the corresponding number of sequential time slots based, at least in part, on the number of active shutter 3D glasses of the wagering game system that have been initiated comprises:

determining the number of distinct channels of images associated with the 3D wagering game content to present sequentially in the common display of the wagering game system during the corresponding number of sequential time slots based on the number of active shutter 3D glasses of the wagering game system that have been initiated and on whether the wagering game system is to implement complementary image cancellation for the 3D wagering game content.

20. The non-transitory machine-readable storage media of claim 18, wherein said operation of transmitting the synchronization signal to the active shutter 3D glasses to synchronize lens film activation operations associated with the active shutter 3D glasses with the presentation of the distinct channels of images associated with the 3D wagering game content in the common display comprises:

generating the synchronization signal based, at least in part, on a timing of the corresponding number of sequential time slots; and transmitting the synchronization signal to each pair of active shutter 3D glasses that has been initiated to synchronize a turning on and off of a left lens film and a right lens film of each pair of active shutter 3D glasses with the presentation of the distinct channels of images associated with the 3D wagering game content in the common display during the corresponding number of sequential time slots.

* * * * *